US005236804A

United States Patent [19]

Tanaka et al.

[11] Patent Number: 5,236,804

[45] Date of Patent: Aug. 17, 1993

[54] SILVER HALIDE PHOTOGRAPHIC LIGHT-SENSITIVE MATERIAL CONTAINING A REDUCIBLE FLUORESCENT RELEASING COMPOUND

[75] Inventors: Shigeo Tanaka, Tachikawa; Hirokazu Sato, Hino; Satoru Ikesu, Hachioji, all of Japan

[73] Assignee: Konica Corporation, Tokyo, Japan

[21] Appl. No.: 660,852

[22] Filed: Feb. 26, 1991

[30] Foreign Application Priority Data

Feb. 28, 1990 [JP] Japan ..... 2-51124

[51] Int. Cl.[5] ..... G03C 1/40; G03C 7/305

[52] U.S. Cl. ..... 430/220; 430/226; 430/543; 430/546; 430/553; 430/555; 430/557; 430/558; 430/631; 430/933; 430/955

[58] Field of Search ..... 430/359, 955, 933, 543, 430/549, 223, 226, 220, 376, 553, 555, 557, 558, 564, 570, 546, 631

[56] References Cited

U.S. PATENT DOCUMENTS

| | | | |
|---|---|---|---|
| 4,774,181 | 9/1988 | Ravindran et al. | 430/226 |
| 4,798,784 | 1/1989 | Kishimoto et al. | 430/382 |
| 4,853,328 | 8/1989 | Okazaki et al. | 435/28 |
| 4,891,309 | 1/1990 | Uesawa et al. | 430/933 |
| 4,942,114 | 7/1990 | Shiba et al. | 430/434 |

FOREIGN PATENT DOCUMENTS

| | | | |
|---|---|---|---|
| 0341884 | 11/1989 | European Pat. Off. . | |
| 62-178954 | 2/1986 | Japan . | |
| 2-132437 | 5/1990 | Japan | 430/933 |
| 945542 | 1/1964 | United Kingdom . | |

OTHER PUBLICATIONS

Research Disclosure 22043, Aug. 1982.

*Primary Examiner*—Lee C. Wright

*Attorney, Agent, or Firm*—Finnegan, Henderson, Farabow, Garrett & Dunner

[57] ABSTRACT

A silver halide photographic light-sensitive material comprises a support having thereon photographic component layers including a silver halide emulsion layer, wherein at least one of said photographic component layers contains a compound represented by the following formula:

A—(Time)n—FL—BL wherein A represents a group capable of releasing a group of —(Time)n—FL—BL upon reaction with an oxidation product of a developing agent; Time represents a timing group; FL represents a group which comes to emit fluorescence when a —BL is split off; BL represents a group capable of being split off; and n represents an integer of 0 or 1.

7 Claims, No Drawings

SILVER HALIDE PHOTOGRAPHIC LIGHT-SENSITIVE MATERIAL CONTAINING A REDUCIBLE FLUORESCENT RELEASING COMPOUND

FIELD OF THE INVENTION

The present invention relates to a silver halide photographic light-sensitive material capable of forming images excellent in reproduction of whiteness, particularly to a silver halide photographic light-sensitive material capable of forming images excellent in reproduction of highly bright subjects.

BACKGROUND OF THE INVENTION

Silver halide photographic light-sensitive materials have come to be extensively used, because of their high sensitivity, excellent gradation and granularity. In a light-sensitive material used to obtain printed images, reproduction of whiteness is strongly required. Japanese Patent Publication Open to Public Inspection (hereinafter referred to as Japanese Patent O.P.I. Publication) No. 93150/1980 discloses a silver halide photographic paper containing at least one oil-soluble dye to keep the hue of a white ground in a printed photographic paper within a range of $W^* = 86$ and more, $U^* = -1$ to 1 and $V^* = -3$ to $-1$ in the $U^*$ $V^*$ $W^*$ color specification; and Japanese Patent Examined Publication No. 7127/1959 discloses a method of manufacturing a photographic paper containing a fluorescent brightener and polyvinylpyrrolidone as a fluorescent intensifier. Further, Research Disclosure (R.D.) No. 20733 (July, 1981) discloses a method to reduce a stain due to residual sensitizing dyes by adding a water-soluble stilbene compound and/or a nonionic surfactant to a developer. However, the method using an oil-soluble dye inevitably lowers brightness. The method which employs a fluorescent brightener and a fluorescent intensifier is liable to generate static marks, particularly in a blue-sensitive layer, due to discharge of static electricity, which is accumulated in transit, in a camera at the time of exposure or in a processing apparatus during development; moreover, the use of these compounds in large quantities is liable to increase a viscosity of a coating solution and lowers its coating property, in addition to a defect of giving rise to a bluish image in high density portion. The method, which uses a water-soluble stilbene compound and/or a nonionic surfactant in a developer to reduce a residual stain of a sensitizing dye, has no substantial effect in reducing the residual stain when the method is used singly.

British Patent No. 945,542 discloses a method to form a color photographic image using a silver halide photographic material containing a coupler having on the coupling position a substituent capable of imparting fluorescence to the coupler. U.S. Pat. No. 3,617,291 discloses a silver halide photographic light-sensitive material containing a two-equivalent, developing-inhibitor-releasing coupler having a benzotriazole group as a group to be split off. While these techniques are effective in improving whiteness of a non-colored portion, they cannot prevent generation of static marks similarly to the technique using a fluorescent brightener and a fluorescent intensifier.

With a view of reproducing a highly bright subject, Japanese Patent O.P.I. Publication No. 142630/1989 discloses a photographic print having a mirror reflectivity or a second class diffuse reflectivity at the surface of a support and having a glossiness of 70 to 5% at the surface of the uppermost light-sensitive layer. But a print of this light-sensitive material is restricted in angles to be illuminated or viewed, and it gives a dark appearance instead of improving whiteness when specific angle conditions are not satisfied; therefore, it cannot reproduce a high brightness properly, though usable as a peculiar style of expression.

Under the circumstances, there has been desired a silver halide color photographic light-sensitive material excellent in whiteness which is essential to a silver halide photographic paper (printing material) and capable of reproducing a high brightness which is not achieved by a conventional photo-sensitive material.

SUMMARY OF THE INVENTION

The present inventors have conducted an intensive study and found that an image excellent in reproduction of whiteness and a high brightness is attained by a silver halide photographic light-sensitive material having on a support one or more photographic component layers including at least one silver halide emulsion layer, wherein at least one of said photographic component layers contains the compound represented by the following Formula [I]:

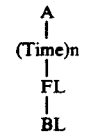

Formula [I]

wherein A represents a group capable of releasing a —(Time)n—FL—BL upon reaction with an oxidation product of a developing agent; Time represents a timing group; FL represents a group which comes to emit fluorescence when a —BL is split off; BL represents a group capable of being split off in a processing solution; and n represents an integer of 0 or 1.

DETAILED DESCRIPTION OF THE INVENTION

The present invention will be hereunder described in detail.

First, the compound represented by Formula [I] will be explained.

In Formula [I], the group represented by A is a group capable of releasing a —(Time)n—FL—BL group upon reaction with an oxidation product of a developing agent, this may be a coupler residue which releases a —(Time)n—FL—BL group on coupling or a group which releases a —(Time)n—FL—BL group by a redox reaction with an oxidation product of a developing agent.

When A is a coupler residue, it may be a yellow coupler residue, magenta coupler residue, cyan coupler residue, or a coupler residue which does not form a virtual image dye. Among them, the preferred coupler residues are those represented by the following Formulas [Ia] to [Ih] and used in the lowermost layer of a light-sensitive material or those represented by these Formulas and forming no virtual image dye.

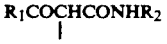

Formula[Ia]

-continued

Formula[Ib]

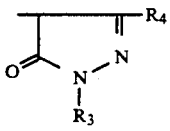

Formula[Ic]

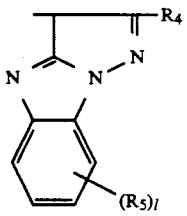

Formula[Id]

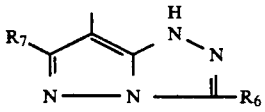

Formula[Ie]

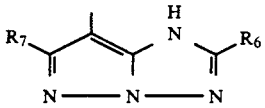

Formula[If]

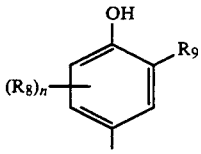

Formula[Ig]

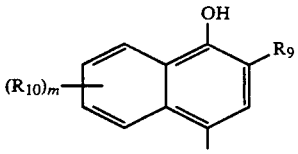

Formula[Ih]

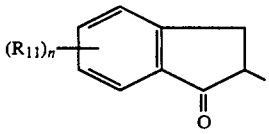

In Formula [Ia], $R_1$ represents an alkyl, aryl, or arylamino group; and $R_2$ represents an ary or alkyl group.

In Formula [Ib], $R_3$ represents an alkyl or aryl group; and $R_4$ represents an alkyl, acylamino, arylamino, arylureido or alkylureido group.

In Formula [Ic], $R_4$ is the same as $R_4$ of Formula [Ib]; $R_5$ represents an acylamino, sulfonamido, alkyl, alkoxy group or a halogen atom.

In Formulas [Id] and [Ie], $R_6$ represents an alkyl or aryl group; $R_7$ represents an alkyl, aryl, acylamino, arylamino, alkoxy, arylureido or alkylureido group.

In Formula [If], $R_8$ represents a halogen atom or an alkyl, alkoxy, acylamino or sulfonamido group; and $R_9$ represents an acylamino, carbambyl or arylureido group.

In Formula [Ig], $R_9$ is the synonymus with $R_9$ of Formula [If]; and $R_{10}$ represents an amino, substituted amino, amido, sulfonamido or hydroxyl group.

In Formula [Ih], $R_{11}$ represents a nitro, acylamino, succinimido, sulfonamido, alkoxy, alkyl or cyano group or a halogen atom.

In these Formulas, l in [Ic] represents an integer from 0 to 3, n in [If] and [Ih] an integer from 0 to 2, m in [Ig] an integer of 0 or 1; and when l or n is 2 or more, R5, $R_8$ and $R_{11}$ may be the same or different from one another.

The above groups include those having a substituent, and the preferred substituents include a halogen atom and a nitro, cyano, sulfonamido, hydroxyl, carboxyl, substituted or non-substituted alkyl, substituted or non-substituted alkoxy, carbonyloxy, acylamino and substituted or non-substituted aryl groups; and those containing a coupler portion which constitutes a so-called bis-type coupler or polymer coupler.

In Formula [I], the timing group represented by Time is used for the purposes of adjusting coupling speed and controlling diffusibility of a group linked with the timing group, and may be or may not be employed according to a purpose. Examples of the timing group represented by Time include ones capable of releasing a photographically useful group by intramolecular nucleophilic substitution after being split off from A by coupling as described in U.S. Pat. No. 4,248,962 and Japanese Patent 0.P.I. Publication No. 56837/1982; ones capable of releasing a photographically useful group by electron transfer via a conjugated system as described in British Patent No. 2,072,363, Japanese Patent O.P.I. Publication Nos.154234/1982 and 188035/1982; and coupling components capable of releasing a photographically useful group by coupling with an oxidized product of an aromatic primary amine developing agent as described in Japanese Patent O.P.I. Publication No. 111536/1982.

Examples of the FL portion are those described in (1) Recent Progress Chem. Nat. and Synth. Coloring Matters and Related Fields; (2) Gore, Joshi, Sunthankar and Tilak editors, Academic Press, New York, N.Y., 1962, pp. 1-11; (3) Angewandte Chemie International Edition in English, Vol. 14 (1975) No. 10, pp. 665-679; (4) Kirk-Othmer Encyclopedia of Chemical Technology, 3rd Edition, Vol. 4, pp. 213-226, John Wiley & Sons, 1978; (5) Cooke et al., Australian J. Chem., 8, pp. 1053-1057 (1975); (6) Cook et al., Australian J. Chem., 30, pp. 2241-2247 (1977); (7) Chaffee et al., Australian J. Chem., 34, pp. 587-598 (1981); (8) Cook et al., Australian J. Chem., 11, pp. 230-235 (1958); and European Patent No. 060518 B1 (issued on Jul. 17, 1985).

Among them, the preferred compounds are those represented by Formulas [IIa] to [IIc]:

[II-a]

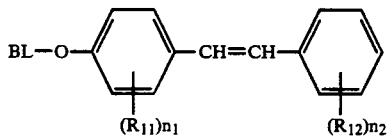

[II-b]

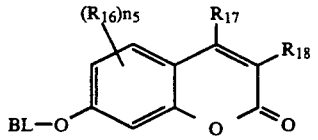

[II-c]

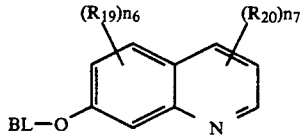

In these Formulas, substituents represented by $R_{11}$ to $R_{20}$ are preferably halogen atoms, or nitro, cyano, sulfonamide, hydroxyl, carboxyl, alkyl, alkoxy, carbonyloxy, acylamino, aryl, amino, carbamoyl or oxycarbonyl groups.

The above groups may contain a substituent. The preferred substituent is a halogen atom, or a nitro, cyano, sulfonamide, hydroxyl, carboxyl, substituted or non-substituted alkyl, substituted or non-substituted alkoxy, carbonyloxy, acylamino, or substituted or non-substituted aryl group.

At least one of $R_{11}$ and $R_{12}$ of [IIa], $R_{16}$ to $R_{18}$ of [IIb] and $R_{19}$ and $R_{20}$ of [IIc] has an A-(Time)n portion without fail.

The FL is a group which comes to emit fluorescence when a BL is split off, but it may or may not come to emit fluorescence when an A or Time group is split off.

The BL is a group which is split off in processing, and may be a group which is split off by hydrolysis in a high pH environment or a group which is split off by hydrolysis after being subjected to redox reaction. Further, it may be a group which is split off through hydrolysis caused by catalytic action of silver ions. The particularly preferred group is a carbonyl group.

Examples of the compound represented by Formula [I] will be illustrated below. But these are mere exemplifications, and the scope of the invention is not limited to them.

Exemplified Compounds (1)

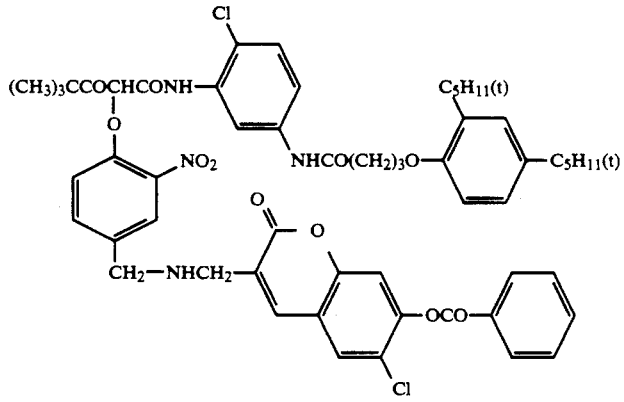

(2)

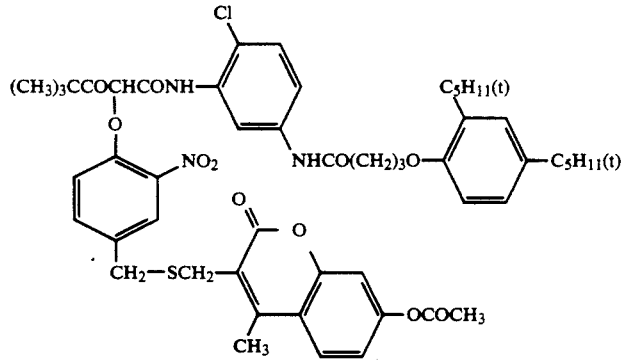

(3)

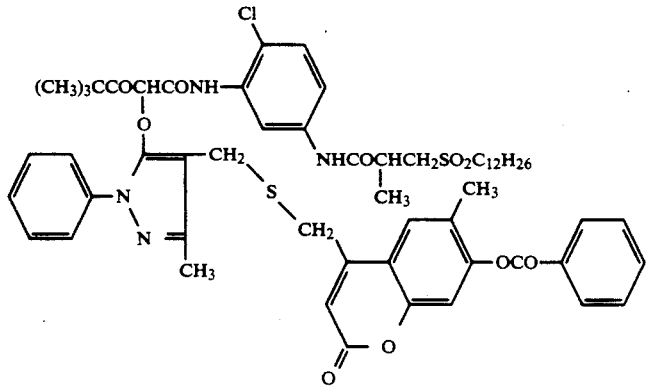

-continued
Exemplified Compounds
(4)
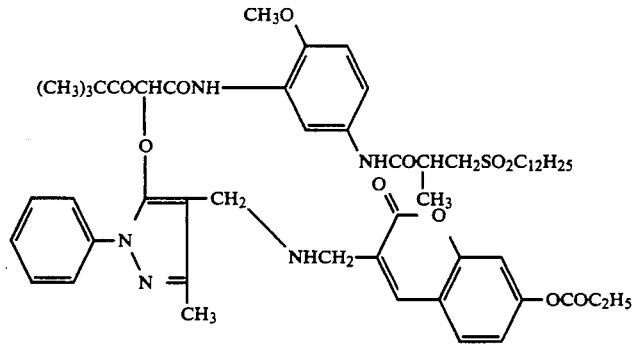
(5)
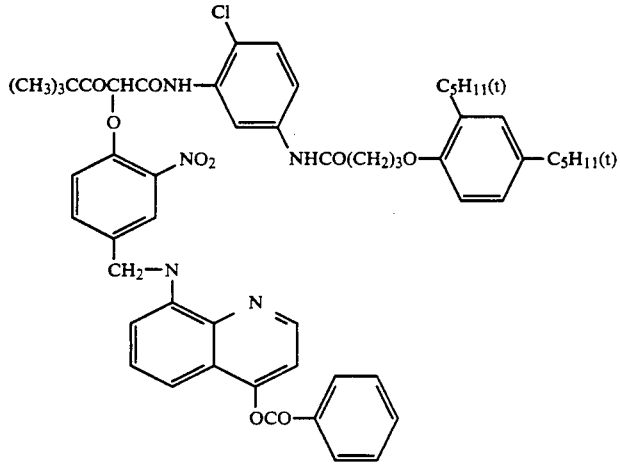
(6)
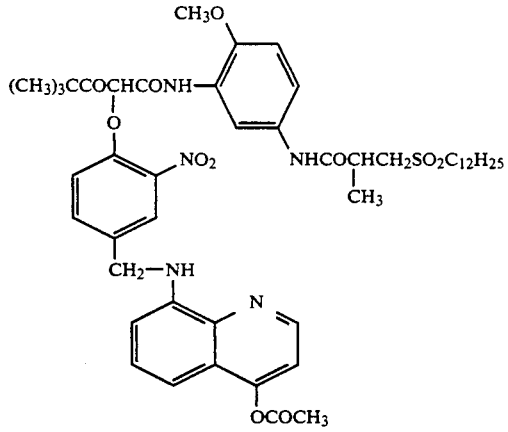
(7)
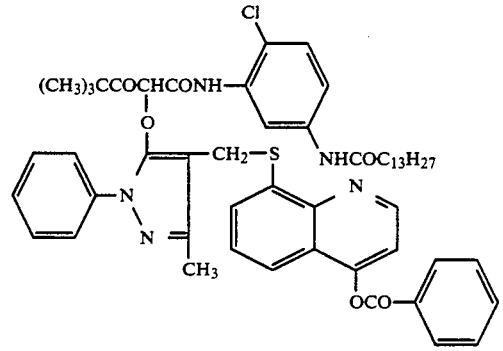

-continued
Exemplified Compounds
(8)
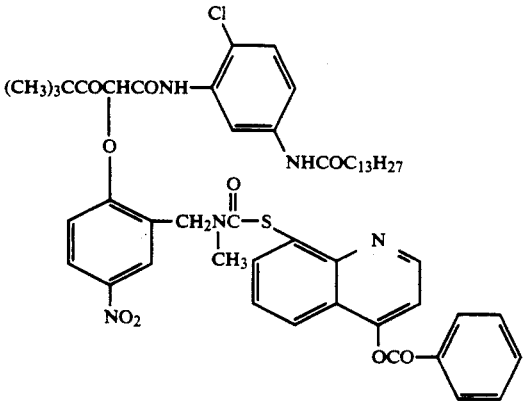
(9)
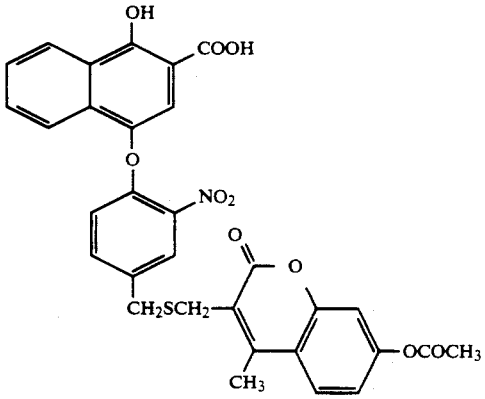
(10)
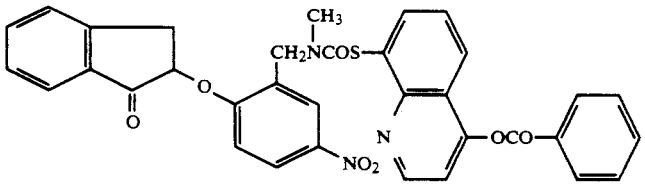
(11)
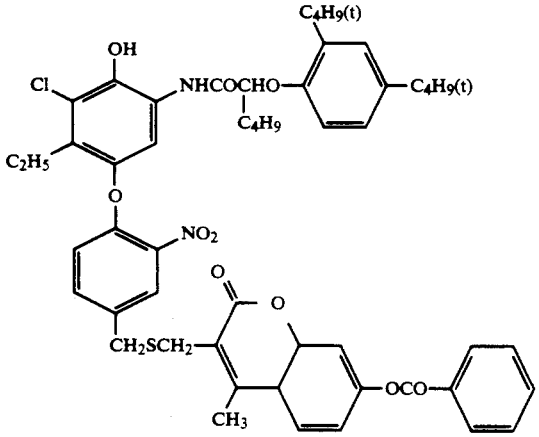

-continued

Exemplified Compounds (12)

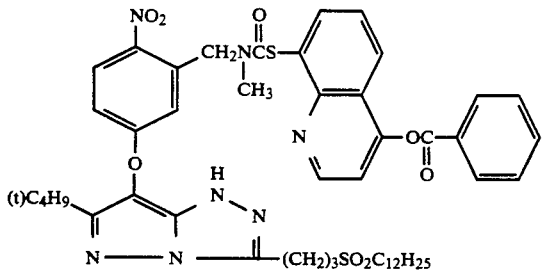

The synthesis method of the exemplified compound 6 will be described below.

Synthesis of Exemplified Compound 6

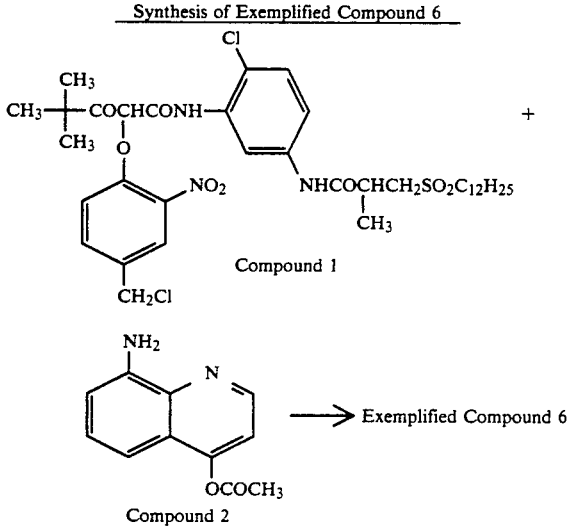

There was dispersed 7.6 g of Compound 1 in 50 ml of ethyl acetate and 0.8 ml of pyridine, and then 2.2 g of Compound 2 was added thereto. Subsequently, the mixture was heated for 2 hours under refluxing. After completion of the reaction, the reaction mixture was washed, and the organic portion was condensed.

The residue obtained was recrystallized from ethanol, so that 9.3 g of Exemplified Compound 6 was obtained. The structure was identified by NMR and MASS.

Exemplified compounds other than the above can also be synthesized by referring to the above synthesis method.

The compound represented by Formula [I] can be contained, like a coupler, in a photographic structural layer of the silver halide photographic light-sensitive material, in the form of a dispersion prepared by dissolving it in a water-insoluble high boiling solvent and then emulsifying the solution or by dispersing it using a water-insoluble and organic-solvent-soluble polymer compound.

The compound represented by Formula [I] may be made into a dispersion in combination with various compounds such as a coupler and anti-color-mixing agent within a limit not injurious to the effect of the invention.

The addition amount of the compound represented by Formula [I] is preferably $1.0\times10^{-5}$ to $1.0\times10^{-2}$ mol/m$^2$ in terms of the coating weight, more preferably $1.0\times10^{-4}$ to $5.0\times10^{-3}$ mol/m$^2$.

The silver halide photographic light-sensitive material of the invention can be favorably used as any of a black and white photographic light-sensitive material which forms an image with metal silver, a black and white photographic light-sensitive material which forms an image with a dye, and a color photographic light-sensitive material.

Conventional yellow couplers, magenta couplers and cyan couplers can be favorably used in the color photographic light-sensitive material of the invention.

Next, the preferred couplers in the invention will be described.

Examples of the preferred yellow coupler are those illustrated below, but not limited to them.

(Y-1)

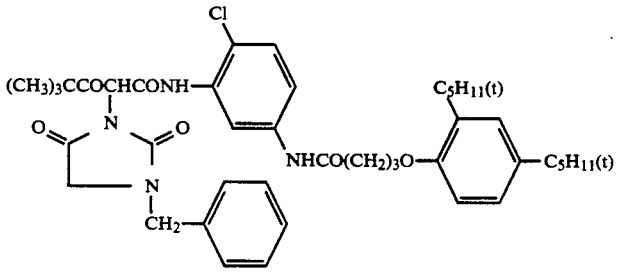

-continued
(Y-2)
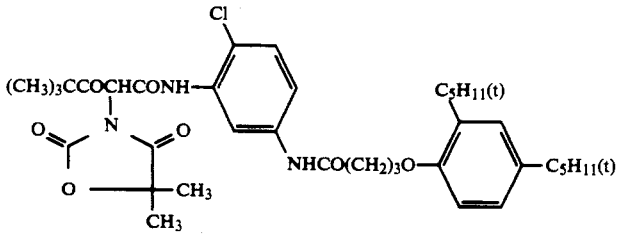
(Y-3)
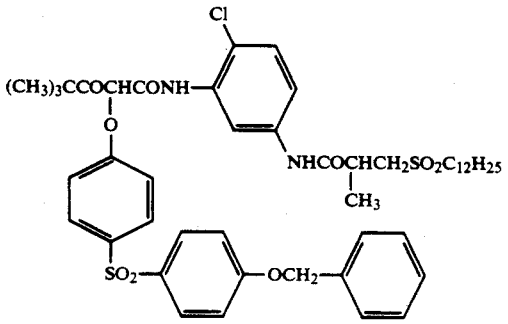
(Y-4)
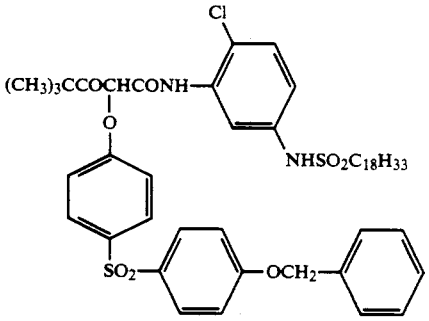
(Y-5)
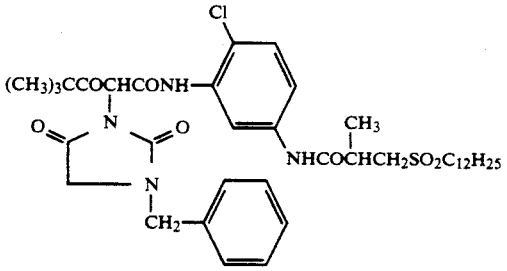
(Y-6)
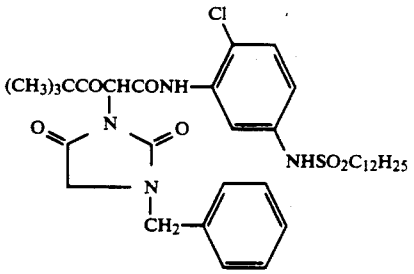
(Y-7)
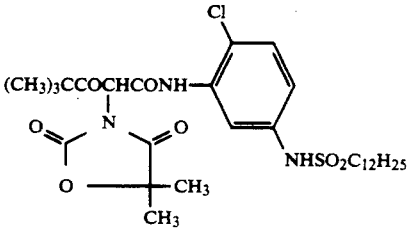

-continued

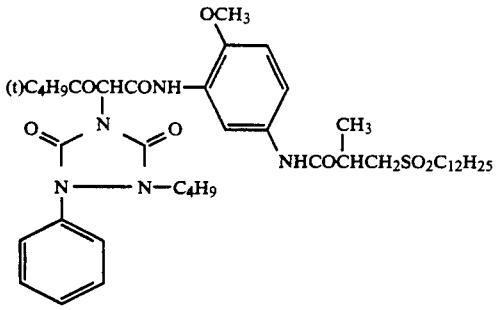

(Y-8)

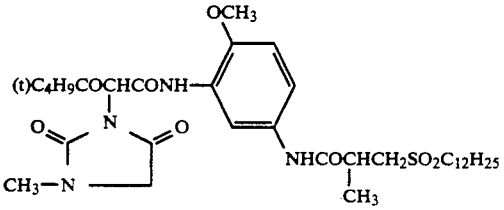

(Y-9)

Examples of the cyan coupler preferred in the silver halide photographic light-sensitive material of the invention include the following compounds:

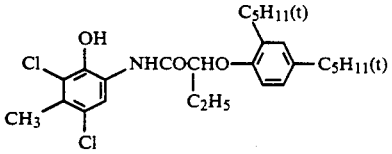

(CC-1)

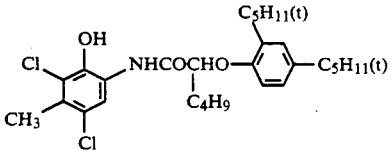

(CC-2)

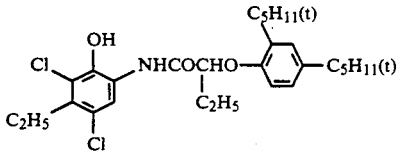

(CC-3)

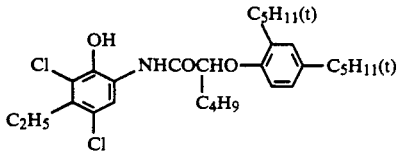

(CC-4)

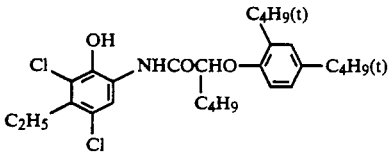

(CC-5)

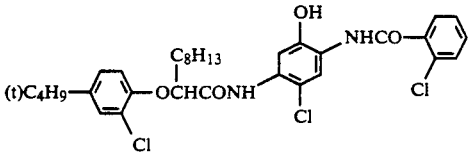

(CC-6)

-continued

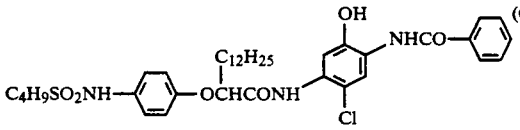

(CC-7)

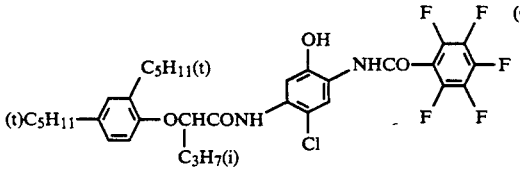

(CC-8)

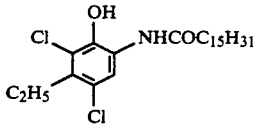

CC-9

In the silver halide light-sensitive material of the invention, the preferred magenta couplers used in combination with the above cyan and yellow couplers are those represented by Formula [M-I]:

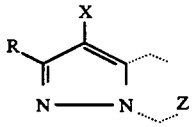

Formula [M-I]

wherein Z represents a nonmetallic atomic group necessary to form a nitrogen-containing heterocycle which may have a substituent; X represents a hydrogen atom or a group capable of being split off upon reaction with an oxidized product of a developing agent; and R represents a hydrogen atom or a substituent.

The substituent represented by R is not particularly limited, but is typically an alkyl, aryl, anilino, acylamino, sulfonamido, alkylthio, arylthio, alkenyl and cycloalkyl group. Other examples include halogen atoms; cycloalkenyl, alkynyl, heterocyclic, sulfonyl, sulfinyl, phosphonyl, acyl, carbamoyl, sulfamoyl, cyano, alkoxy, aryloxy, heterocycloxy, siloxy, acyloxy, carbamoyloxy, amino, alkylamino, imide, ureido, sulfamoylamino, alkoxycarbonylamino, aryloxycarbonylamino, alkoxycarbonyl, aryloxycarbonyl, and heterocyclothio groups; and spiro-compound residue and bridged hydrocarbon residue.

The alkyl group represented by R has preferably 1 to 32 carbon atoms and may be straight-chained or branched.

The aryl group represented by R is preferably a phenyl group.

Examples of the acylamino group represented by R include alkylcarbonylamino and arylcarbonylamino groups.

Examples of the sulfonamido group represented by R include alkylsulfonylamino and arylsulfonylamino groups.

An alkyl component and aryl component in the alkyothio group and arylthio group are the alkyl group or aryl group represented by the above R.

The alkenyl group represented by R is preferably one having 2 to 32 carbon atoms; the cyclalkyl group is preferably one having 3 to 12 carbon atoms, particularly 5 to 7 carbon atoms; where the alkenyl group may be straight-chained or branched.

The cyclalkenyl group represented by R is preferably one having 3 to 12 carbon atoms, particularly 5 to 7 carbon atoms.

Examples of the sulfonyl group represented by R include alkylsulfonyl and arylsulfonyl groups.

Examples of the sulfinyl group include alkylsulfinyl and arylsulfinyl groups.

Examples of the phosphonyl group include alkylphophonyl, alkoxyphosphonyl, aryloxyphosphonyl and arylphosphonyl groups.

Examples of the acyl group include alkylcarbonyl and arylcarbonyl groups.

Examples of the carbamoyl group include alkylcarbamoyl and arylcarbamoyl groups.

Examples of the sulfamoyl group include alkylsulfamoyl and arylsulfamoyl groups.

Examples of the acyloxy group include alkylcarbonyloxy and arylcarbonyloxy groups.

Examples of the carbamoyloxy group include alkylcarbamoyloxy and arylcarbamoyloxy groups.

Examples of the ureido group include alkylureido and arylureido groups.

Examples of the sulfamoylamino group include alkylsulfamoylamino and arylsulfamoylamino groups.

The heterocyclic group is preferably a five- to seven-membered one, such as 2-furil group, 2-thienyl group, 2-pyrimidinyl group and 2-benzothiazolyl group.

The heterocycloxy group is preferably one having a five- to seven-membered heterocycle, such as 3,4,5,6-tetrahydropyranyl-2-oxy group and 1-phenyl-tetrazole-5-oxy group.

The heterocyclothio group is preferably a five- to seven-membered heterocyclothio group; examples thereof include 2-pyridylthio group, 2-benzothiazolylthio group and 2,4-diphenoxy-1,3,5-triazole-6-thio group.

Examples of the siloxy group include trimethylsiloxy, triethylsiloxy and dimethylbutylsiloxy groups.

Examples of the imide group include succinimide, 3-heptadecyl succinimide, phthalimide and glutarimide groups.

Examples of the spiro compound include spiro[3,3-]heptane-1-yl.

Examples of the bridged hydrocarbon include bicyclo[2,2,1]heptane-1-yl, tricyclo[3,3,1,1$^{3,7}$] decane-1-yl and 7,7-dimethyl-bicyclo[2,2,1]heptane-1-yl.

Examples of the group which is capable of being split off by reaction with an oxidation product of a developing agent include halogen atoms (e.g., chlorine, bromine and fluorine atoms); alkoxy, aryloxy, heterocycloxy, acyloxy, sulfonyloxy, alkoxycarbonyloxy, aryloxycarbonyloxy, alkyloxalyloxy, alkoxyoxalyloxy, alkylthio, arylthio, heterocyclothio, alkyloxycarbonylthio, acylamino, sulfonamide, N-atom bonded nitrogen-containing heterocycle, alkyloxycarbonylamino, aryloxycarbonylamino, carboxyl, and

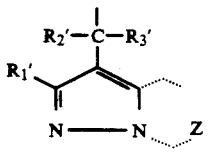

(wherein $R_1'$ is the same as the foregoing R; Z' is the same as the foregoing Z; $R_2'$ and $R_3'$ independently represent a hydrogen atom, or aryl, alkyl or heterocyclic group). Among them, the particularly preferred one is a halogen atom, especially, chlorine atom.

Examples of the nitrogen-containing heterocycle formed by Z or Z' include pyrazole, imidazole, triazole and tetrazole rings. Examples of the substituent which the above rings may have include ones described with respect to the previously defined R.

The couplers represented by Formula [M-I] are more specifically represented by the following Formulas [M-II] through [M-VII]:

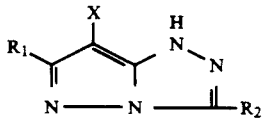

Formula[M-II]

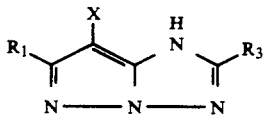

Formula[M-III]

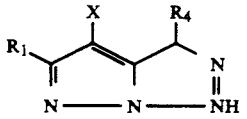

Formula[M-IV]

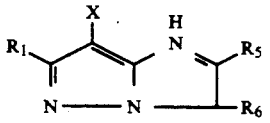

Formula[M-V]

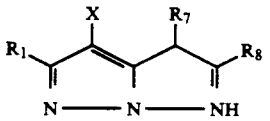

Formula[M-VI]

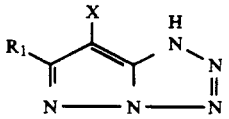

Formula[M-VII]

In Formulas [M-I] to [M-VII], $R_1$ to $R_8$ and X are the same as the previously defined R and X.

Among the couplers represented by Formula [M-I], the particularly preferred are those represented by the following Formula [M-VIII]:

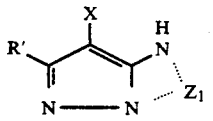

Formula[M-VIII]

wherein $R_1$, X and $Z_1$ are the same as the R, X and Z in Formula [M-I].

Of the magenta couplers represented by Formulas [M-II] to [M-VII], the particularly preferred are those represented by Formula [M-II].

As the substituent R or $R_1$ on the foregoing heterocycle, the particularly preferred are those represented by Formula [M-IX].

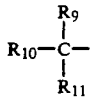

Formula[M-IX]

wherein $R_9$, $R_{10}$ and $R_{11}$ are the same as the foregoing R.

Two of the above $R_9$, $R_{10}$ and $R_{11}$, for example, $R_9$ and $R_{10}$, may be linked to each other to form a saturated or unsaturated ring (e.g., cycloalkane, cycloalkene or heterocylcle); moreover, $R_{11}$ may be combined with the ring to form a hydrocarbon residue.

Among the couplers represented by Formula [M-IX], the prepared ones are (i) those in which at least two of $R_9$ to $R_{11}$ are alkyl groups and (ii) those in which one of $R_9$ through $R_{11}$ (for example, $R_{11}$) is a hydrogen atom, while the other two ($R_9$ and $R_{10}$) are linked together to form a hydrocarbon residue.

In the above (i), the particularly preferred are those in which two of $R_9$ to $R_{11}$ are alkyl groups and the other one is a hydrogen atom or an alkyl group.

Further, the substituent on the ring formed by Z in Formula [M-1], the substituent which the ring formed by $Z_1$ of Formula [M-VIII] may have, and $R_2$ to $R_8$ in Formulas [M-II] to [M-VI] are preferably those represented by Formula [M-X].

$$-R^1-SO_2-R^2$$ Formula[M-X]

wherein $R^1$ represents an alkylene group; and $R^2$ represents an alkyl, cycloalkyl or aryl group.

The aykylene group represented by $R^1$ has preferably at least 2 carbon atoms in the linear portion, more preferably 3 to 6 carbon atoms, irrespective of being straight-chained or branched ones.

The alkyl group represented by $R^2$ is preferably a five- to six-membered one.

Typical examples of the compound represented by Formula [M-X] are shown hereunder.

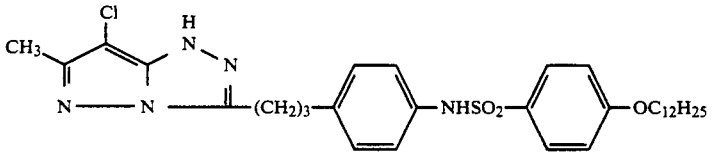

[M-1]

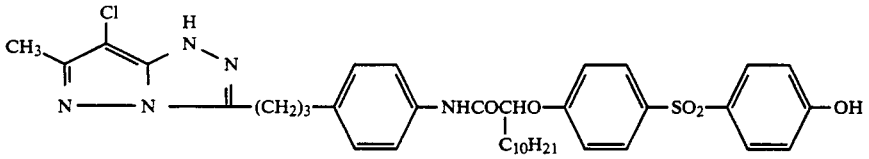

[M-2]

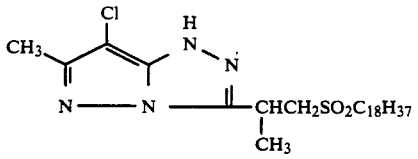

[M-3]

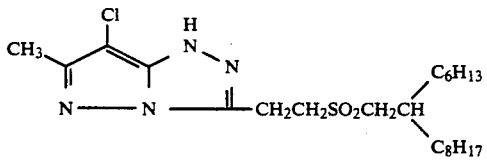

[M-4]

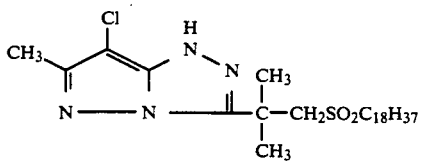

[M-5]

-continued
[M-6]
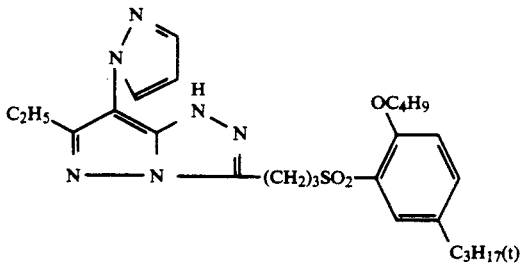
[M-7]
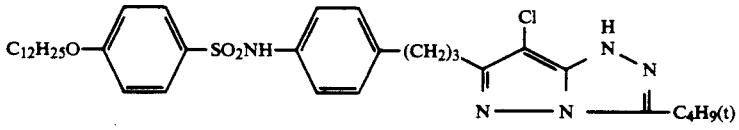
[M-8]
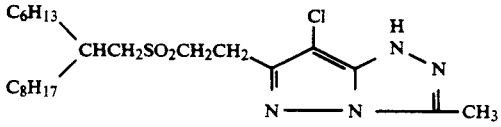
[M-9]
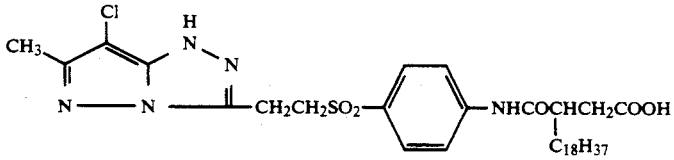
[M-10]
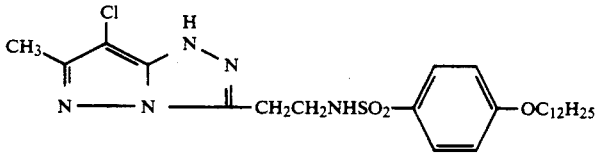
[M-11]
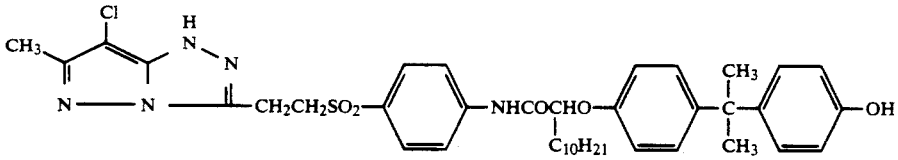
[M-12]
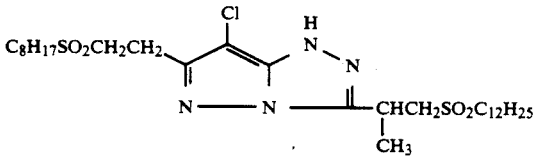
[M-13]
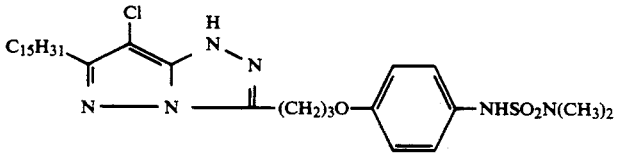
[M-14]
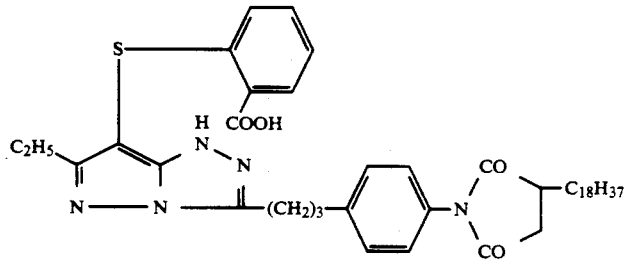

-continued
[M-15]
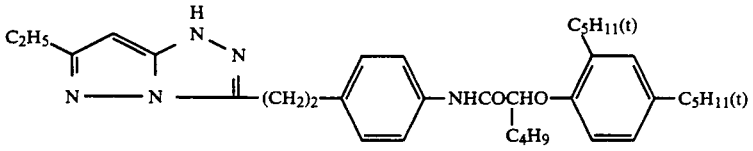
[M-16]
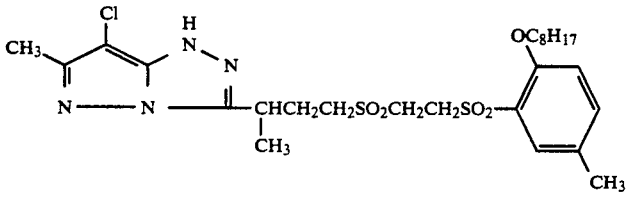
[M-17]
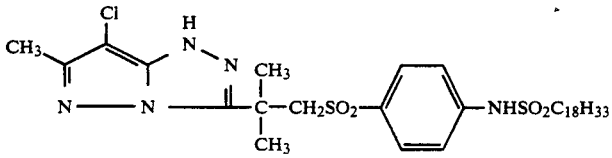
[M-18]
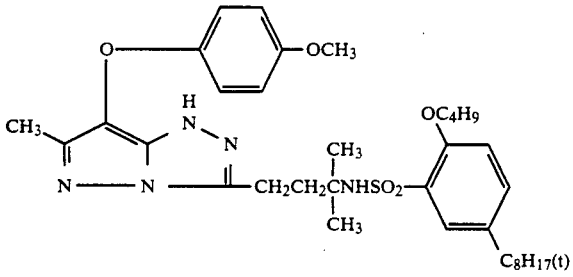
[M-19]
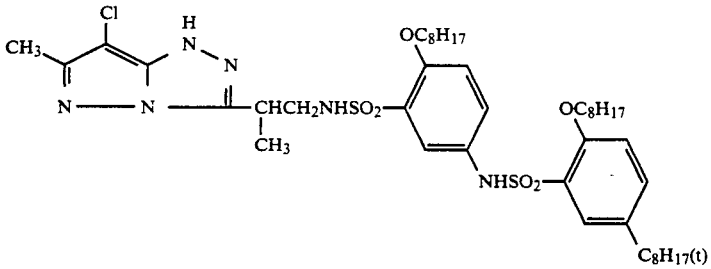
[M-20]
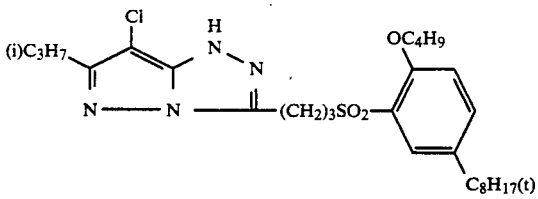
[M-21]
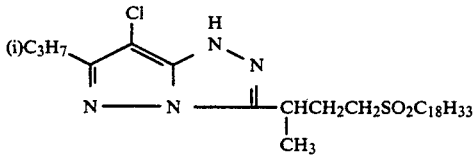
[M-22]
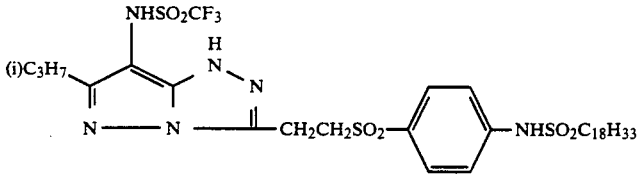

-continued
[M-23]
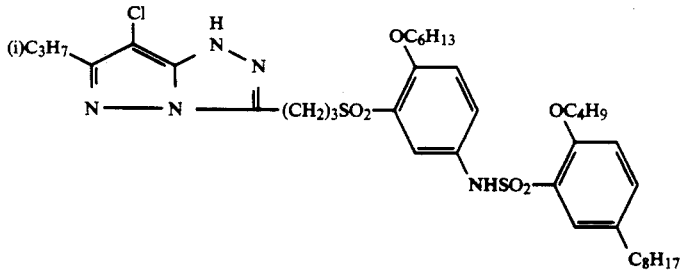
[M-24]
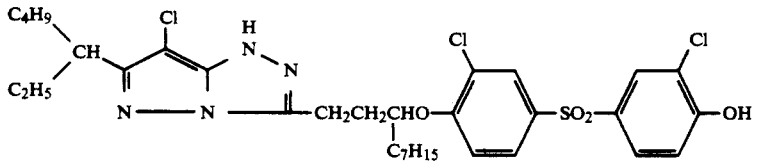
[M-25]
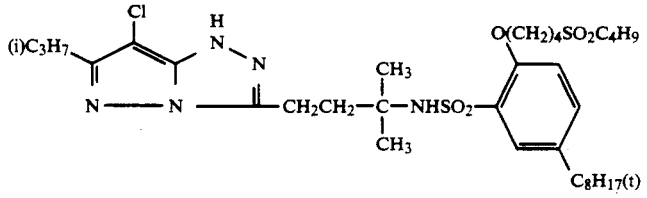
[M-26]
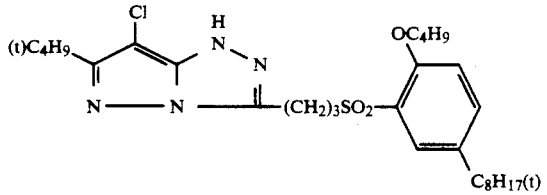
[M-27]
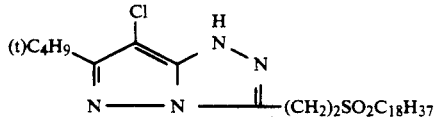
[M-28]
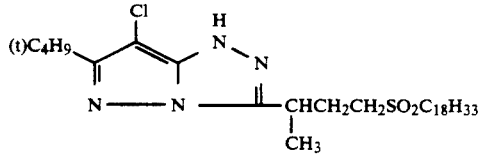
[M-29]
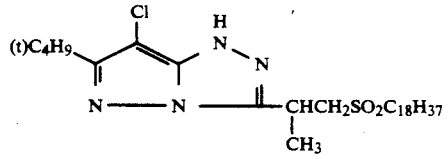
[M-30]
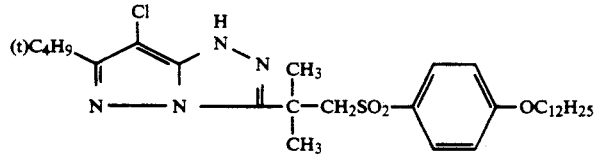
[M-31]
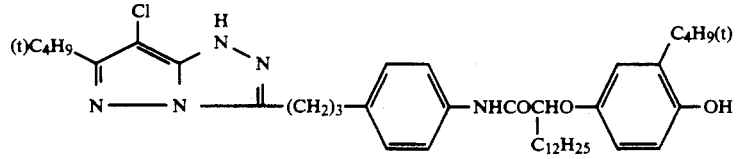

-continued
[M-32]
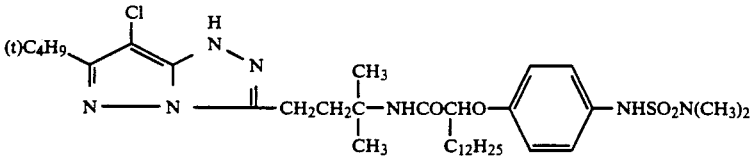
[M-33]
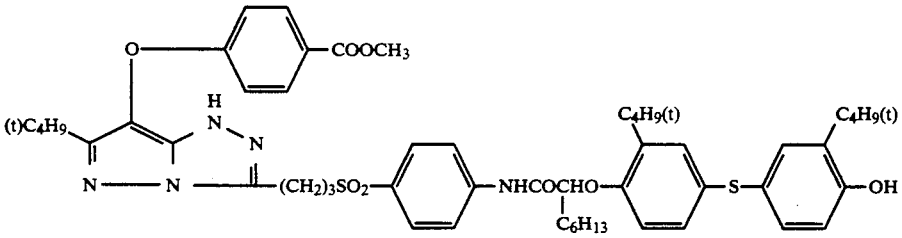
[M-34]
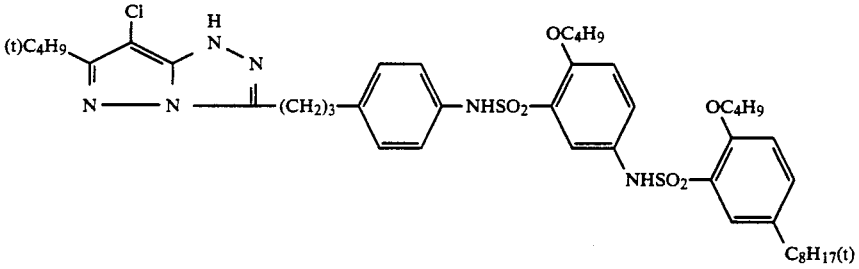
[M-35]
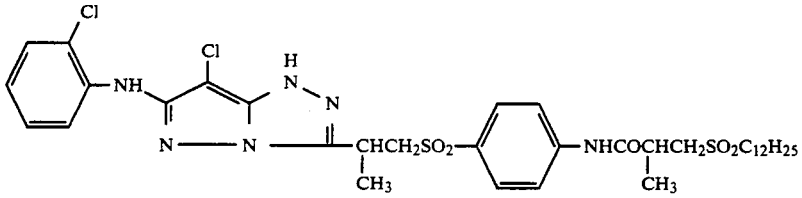
[M-36]
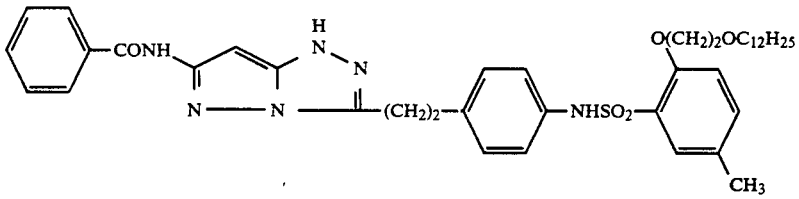
[M-37]
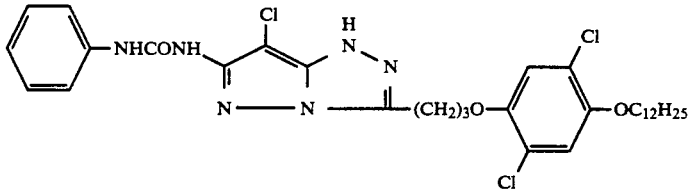
[M-38]
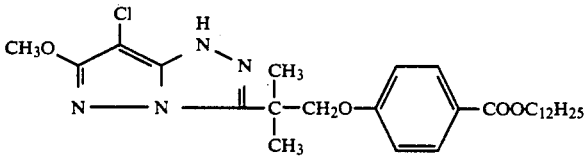

-continued
[M-39]
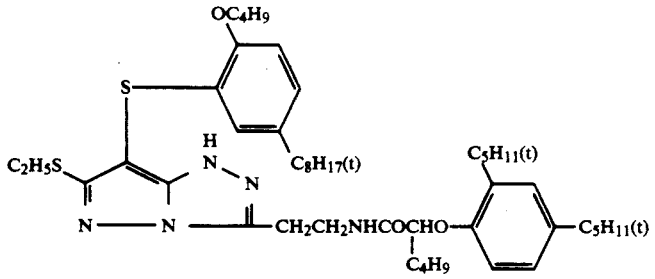
[M-40]
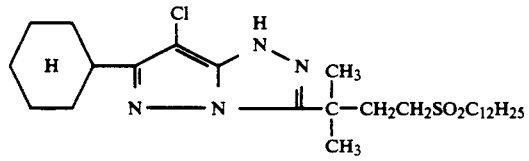
[M-41]
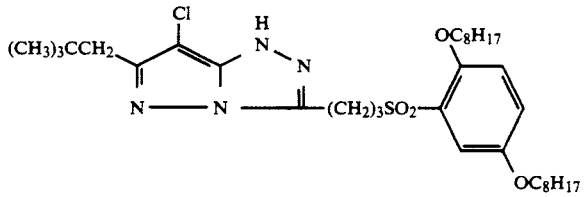
[M-42]
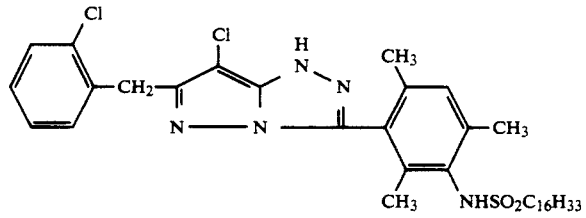
[M-43]
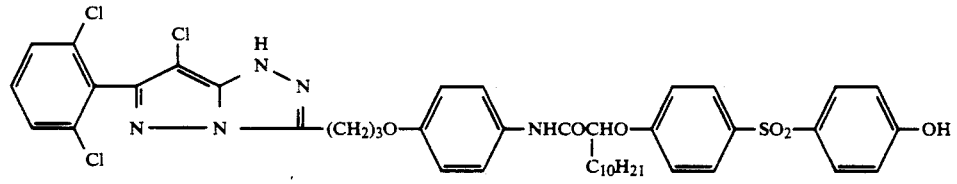
[M-44]
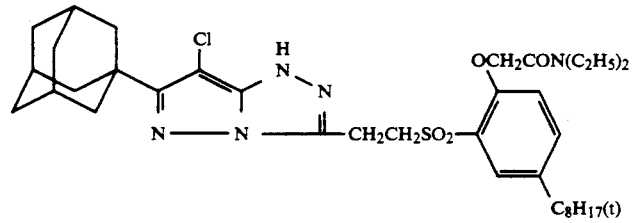
[M-45]
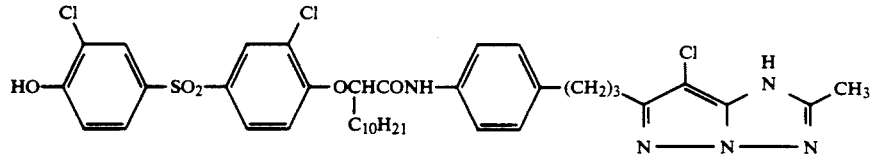

-continued
[M-46]
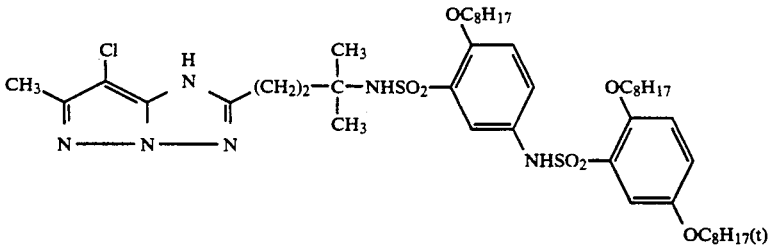
[M-47]
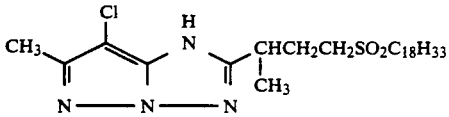
[M-48]
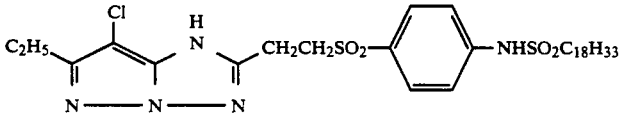
[M-49]
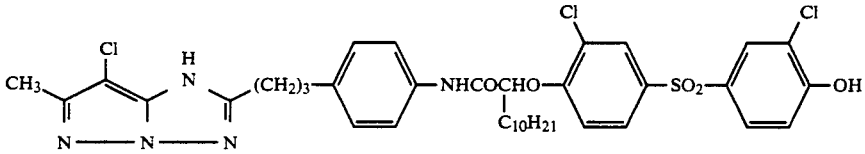
[M-50]
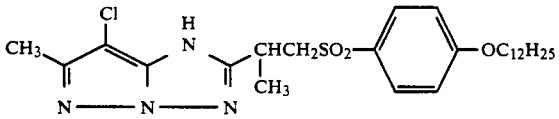
[M-51]
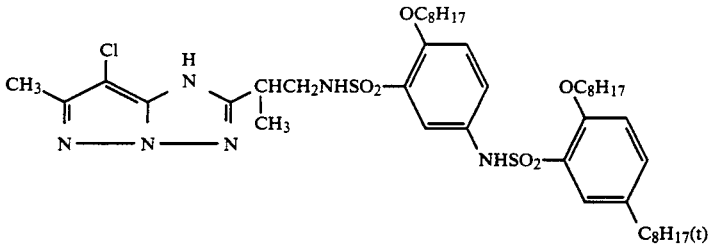
[M-52]
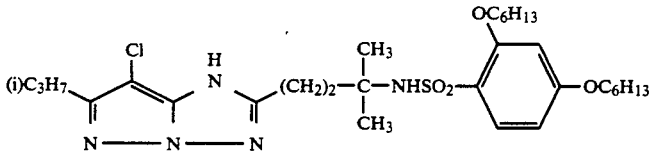
[M-53]
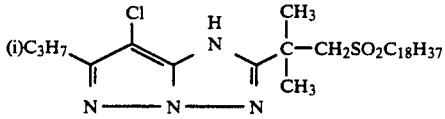
[M-54]
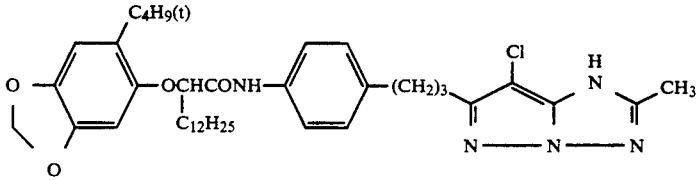

-continued
[M-55]
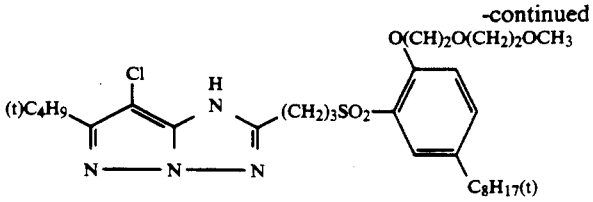
[M-56]
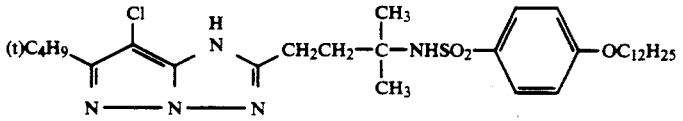
[M-57]
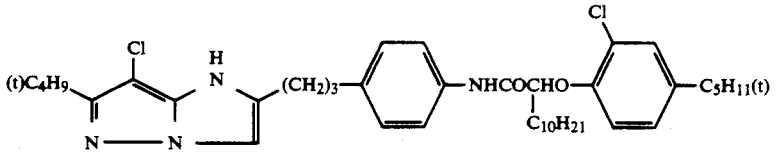
[M-58]
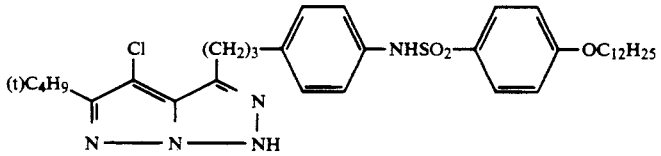
[M-59]
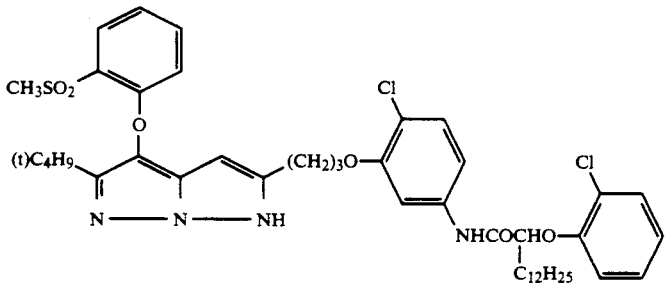
[M-60]
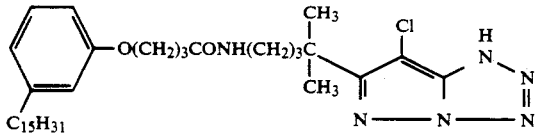
[M-61]
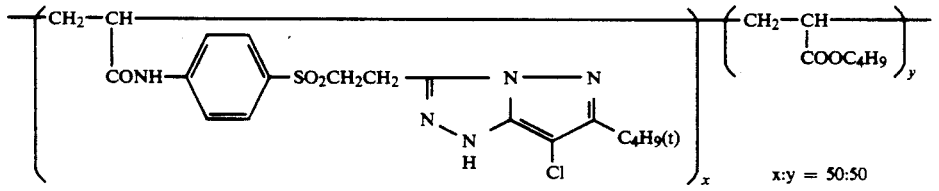
x:y = 50:50
[M-62]
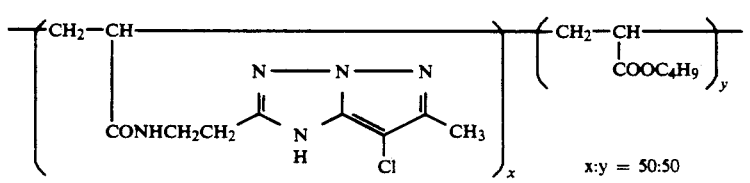
x:y = 50:50
[M-63]
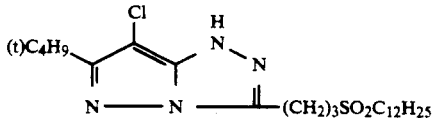

-continued

[M-64]

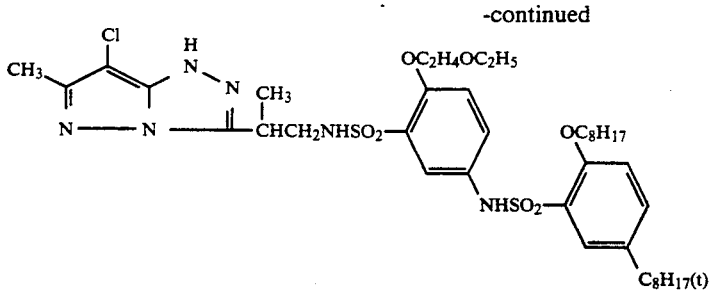

In addition to the above examples of the magenta coupler, the magenta couplers represented by the following Formula [M-XI] are preferably used in the invention.

Formula [M-XI]:

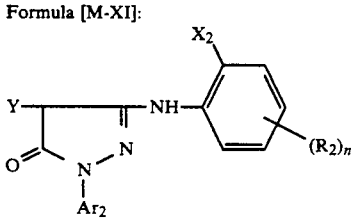

wherein $Ar_2$ represents an aryl group; $X_2$ represents a halogen atom, alkoxy group or alkyl group; $R_2$ represents a group capable of being substituted on a benzene ring; n represents 1 or 2, $R_2$ may be the same or different when n is 2; and Y represents a hydrogen atom or a group capable of being split off upon coupling with an oxidation product of an aromatic primary amine developing agent.

In Formula [M-XI], the group represented by Y and capable of being split off upon coupling with an oxidation product of an aromatic primary amine developing agent is, for example, a halogen atom; alkoxy, aryloxy, acyloxy, arylthio or alkylthio group; or

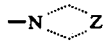

(where Z represents a group of atoms necessary to form a five- or six-membered ring in combination with the nitrogen atom and atoms selected from carbon atoms, oxygen atoms, nitrogen atoms and sulfur atoms). In this case, Y does not stand for a hydrogen atom.

Examples of the group represented by Y include halogen atoms such as chlorine, bromine and fluorine; alkoxy groups such as ethoxy, benzyloxy, methoxyethyl carbamoylmethoxy, tertadecyl carbamoylmethoxy; aryloxy groups such as phenoxy, 4-methoxyphenoxy and 4-nitrophenoxy; acyloxy groups such as acetoxy, myristoyloxy and benzoyloxy; arylthio groups such as phenylthio, 2-butoxy-5-octylphenylthio and 2,5-dihexyloxyphenylthio; alkylthio groups such as methylthio, octylthio, hexadecylthio, benzylthio, 2-(diethylamino)ethylthio, ethoxycarbonylmethylthio, ethoxydiethylthio and phenoxyethylthio; and

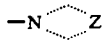

such as pyrazolyl, imidazolyl, triazolyl and tetrazolyl.

Examples of the compound represented by Formula [M-XI] will be illustrated below.

[M-65]

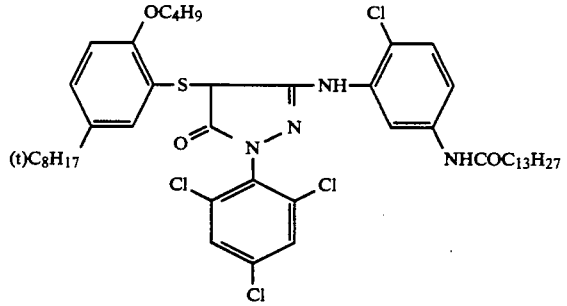

[M-66]

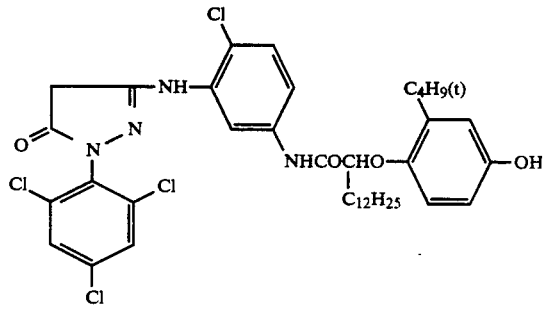

-continued
[M-67]
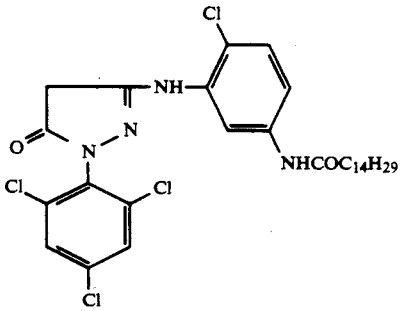
[M-68]
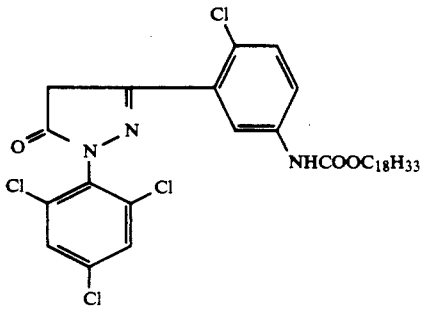
[M-69]
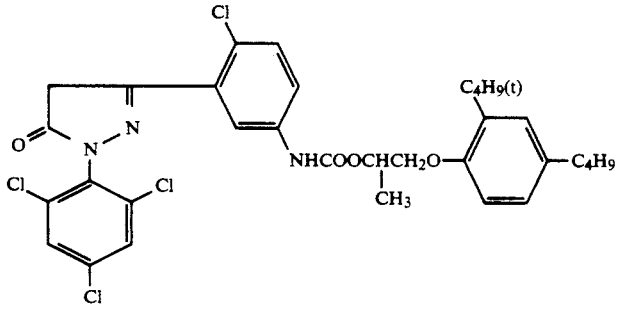
[M-70]
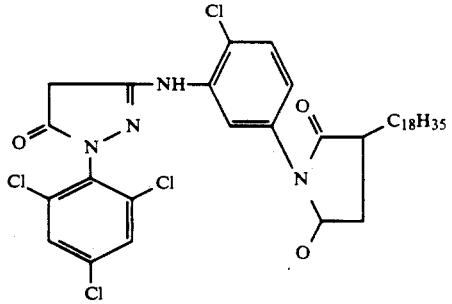
[M-71]
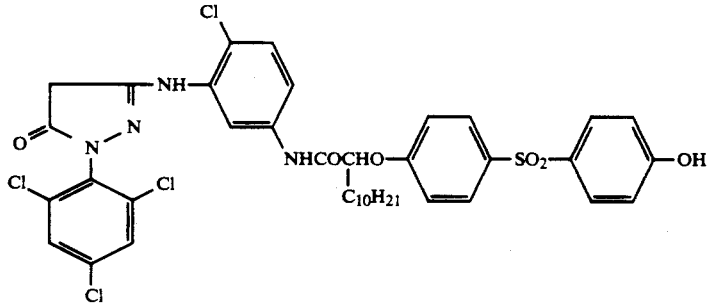
Other than the foregoing typical examples, examples of the compound represented by the foregoing Formula [M-I] include those described on page 18 through 32 of the specification of Japanese Patent O.P.I. Publication No. 166339/1987.
Examples of the compound represented by Formula [M-XI] also include ones described in U.S. Pat. Nos.

2,600,788, 3,061,432, 3,062,653, 3,127,269, 3,311,476, 3,152,896, 3,419,391 and 3,519,429.

The addition amount of the foregoing yellow coupler is preferably $2\times10^{-3}$ to $5\times10^{-1}$ mol per mol of silver halide, more preferably $1\times10^{-2}$ to $5\times10^{-1}$ mol.

The addition amount of the foregoing magenta coupler is preferably $1\times10^{-3}$ to 2 mol per mol of silver halide, more preferably $1\times10^{-2}$ to 1 mol per mol of silver halide.

The addition amount of the foregoing cyan coupler is preferably $1\times10^{-3}$ to 1 mol per mol of silver halide, more preferably $1\times10^{-2}$ to $5\times10^{-1}$ mol.

To add the compound represented by Formula [I] and coupler to a silver halide emulsion by the oil-in-water type emulsifying method, they are generally dissolved in a water-insoluble high boiling solvent having a boiling point of 150° C. or more, or in combination with a low boiling solvent and/or a water-soluble solvent if necessary, and the solution is emulsified in a hydrophilic binder such as aqueous solution of gelatin with aids of a surfactant and dispersing means such as stirrer, homogenizer, colloid mill, flow jet mixer and supersonic apparatus, and subsequently, the dispersion is added to a proper photographic construction layer (hydrophilic colloid layer).

After dispersing or concurrently with dispersing, a process to remove a low boiling solvent may be provided.

Examples of the high boiling solvent employed for such purpose are phthalate such as dibutyl phthalate, di-(2-ethylhexyl)phthalate, dinonyl phthalate and dicyclohexyl phthalate; phosphates such as tricresyl phosphate, tri-(2-ethylhexyl)phosphate, diphenyl-cresyl-phosphate and trihexyl phosphate; amides such as diethyl lauramide and dibutyl lauramide; phenols such as dinonyl phenol and p-dodecyl phenol; hydrocarbons such as decalin and dodecyl benzene; and esters such as 1,4-bis(2-ethylhexylcarbonyloxymethyl)chclohexane and dinonyl adipate. Among them, phthalate, phosphates and other organic esters are particularly preferred. These high boiling solvents may be used singly or in combination.

Water-insoluble organic-solvent-soluble polymers used to disperse the compound represented by Formula [I] and coupler can be classified as follows:

(1) Vinyl polymers and copolymers
(2) Condensation products of polyhydric alcohol and polybasic acid
(3) Polyesters obtained by ring-opening polymerization
(4) Others (polycarbonate, polyurethane, polyamide, etc.)

The degree of polymerization of these polymers is not particularly limited, but is preferably 200,000 or less, more preferably 5,000 to 100,000. The addition ratio (by weight) to the compound represented by Formula [I] and coupler is preferably 1:20 to 20:1, more preferably 1:10 to 10:1. The following are examples of the preferred polymers (for copolymers, weight ratios of monomer are shown):

(PO-1) Poly(N-t-butyl acrylamide)
(PO-2) N-t-butyl acrylamide-methyl methacrylate copolymer (60:40)
(PO-3) Polybutylmethacyrate
(PO-4) Methyl methacrylate-styrene copolymer (90:10)
(PO-5) N-t-butyl acrylamide-2-methoxyethyl acrylate copolymer (55:45)
(PO-6) ω-methoxy polyethylene glycol acrylate (the number of mols added, n =9)-N-t-butyl acrylamide copolymer (25:75)
(PO-7) 1,4-butanediol-adipic acid polyester
(PO-8) Polypropiolactam In the light-sensitive material of the invention, various compounds may be added to improve durability of image forming dyes. The compounds described in Japanese Patent O.P.I. Publication Nos. 166339/1987 and 254149/1987 and represented by the following Formulas [a] to [c] can be advantageously used, because these have no adverse effect on couplers' color forming properties and effectiveness of the invention.

Formula [a]:

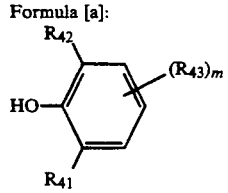

wherein $R_{41}$ and $R_{42}$ independently represent an alkyl group; $R_{43}$ represents an alkyl, —NR'R", —SR' (R' is a univalent organic group) or —COOR" group (R" is a hydrogen atom or univalent organic group); and m represents an integer from 0 to 3.

Formula [b]

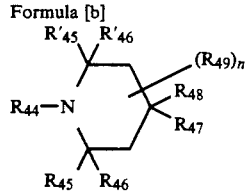

wherein $R_{44}$ represents a hydrogen atom or a hydroxyl, oxy-radical (—O group), —SOR', —$SO_2$R' (R' is a univalent organic group), alkyl, alkenyl, alkynyl or —COR" group (R" is a hydrogen atom or univalent organic group); $R_{45}$, $R_{46}$, $R_{45}'$, $R_{46}'$ and $R_{49}$ independently represent an alkyl group, $R_{47}$ and $R_{48}$ may independently be a hydrogen atom or —$OCOR_{50}$ group ($R_{50}$ is a univalent organic group) or may jointly form a heterocycle; and n represents an integer of 0 to 4.

Formula [c]

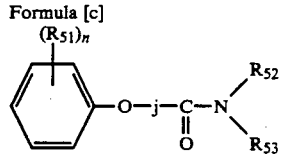

wherein $R_{51}$ represents an alkyl or alkoxy group; J represents an alkylene group; $R_{52}$ and $R_{53}$ independently represent an alkyl group; and n represents an integer of 1 to 3, $R_{51}$ may be the same or different from each other when n is 2 or more.

The alkyl group represented by $R_{41}$ or $R_{42}$ of Formula [a] is preferably one having 1 to 12 carbon atoms, the more preferable one is an alkyl group having 3 to 8 carbon atoms and branced at the α position. The most preferable one is a t-butyl group or t-pentyl group.

The alkyl group represented by $R_{43}$ is of straight chain or branched chain, such as methyl, ethyl, propyl, butyl, pentyl, octyl, nonyl, dodecyl and octadecyl.

These alkyl groups may have a substituent. Examples of the amino group represented by $R_{43}$ include alkylamino, arylamino, cycloalkylamino and heterocycloamino groups.

Examples of the univalent organic group represented by R′ or R″ include alkyl, aryl, cycloalkyl and heterocyclic groups, each of which may have a substituent.

The alkyl group represented by $R_{44}$ of Formula [b] is preferably one having 1 to 12 carbon atoms. the alkenyl or alkynyl group has preferably 2 to 4 carbon atoms, and the univalent organic group represented by R′ or R″ is an alkyl, alkenyl, alkynyl or aryl group.

The alkyl group represented by $R_{45}$, $R_{46}$, $R_{45}'$, $R_{46}'$ or $R_{49}$ is preferably a straight-chained or branched alkyl group having 1 to 5 carbon atoms. The particularly preferred one is a methyl group.

The univalent organic group represented by $R_{50}$ in $R_{47}$ and $R_{48}$ is an alkyl, alkenyl, alkynyl, aryl, alkylamino or arylamino group.

In the compound represented by Formula [c], the alkyl group represented by $R_{51}$ has preferably 1 to 18 carbon atoms; examples thereof include methyl, ethyl, butyl, t-butyl, t-amyl, hexyl, octyl, 2-ethylhexyl, decyl and octadecyl groups. The alkoxy group represented by $R_{51}$ includes methoxy, ethoxy, butoxy, octyloxy and dodecyloxy groups.

The alkyl group represented by $R_{52}$ and $R_{53}$ is preferably a straight-chained or branched alkyl group having 1 to 8 carbon atoms; examples thereof include methyl, ethyl, butyl and hexyl groups.

The alkylene group expressed by J is preferably a straight-chained or branched alkylene group having 1 to 8 carbon atoms.

Typical examples of the above compounds will be illustrated below.

Exemplified Compound of Formula [a]

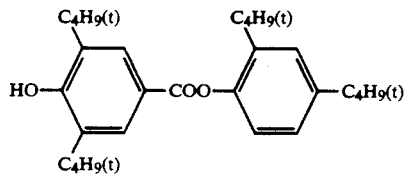

(a-1)

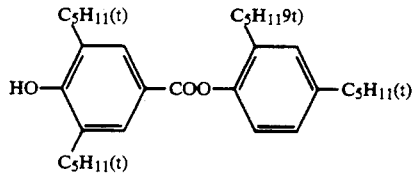

(a-2)

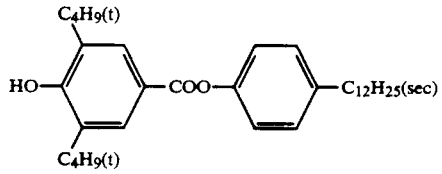

(a-3)

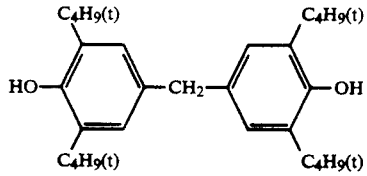

(a-4)

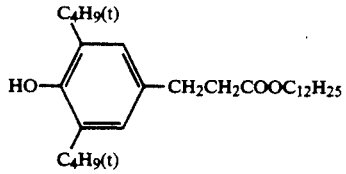

(a-5)

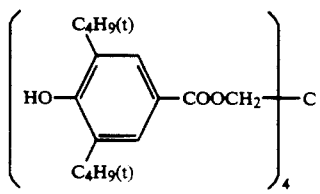

(a-6)

-continued
(a-7)
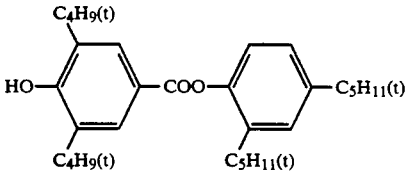
(a-8)
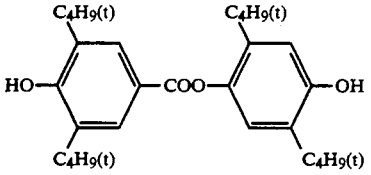
Exemplified Compound of Formula [b]
(b-1)
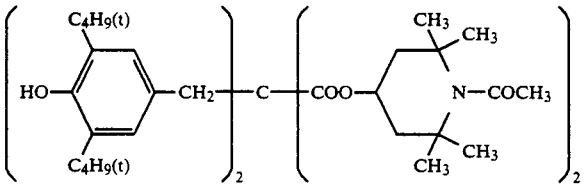
(b-2)
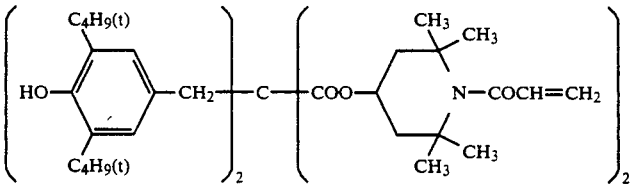
(b-3)
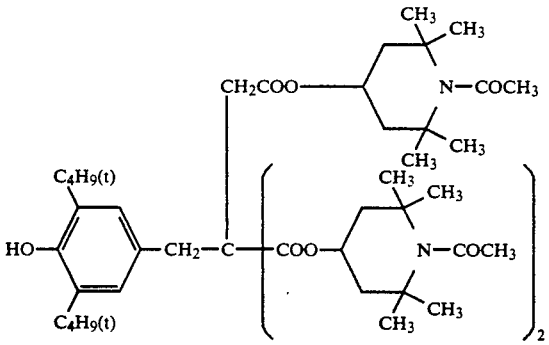
(b-4)
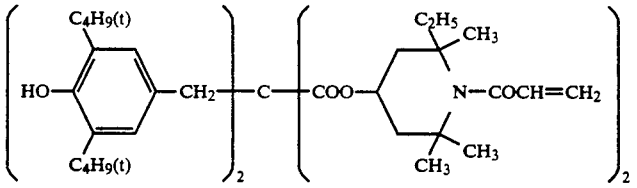
(b-5)
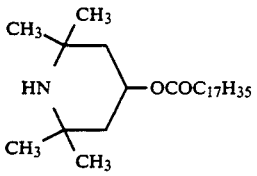

-continued (b-6)

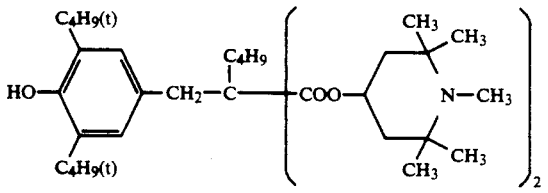

Exemplified Compound of Formula[c]

(c-1)

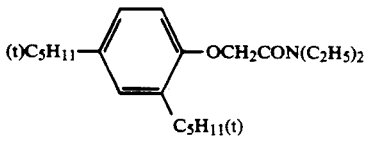

(c-2)

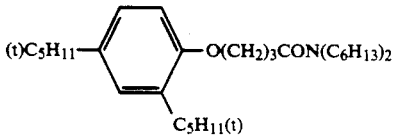

(c-3)

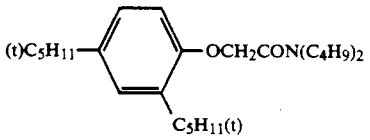

(c-4)

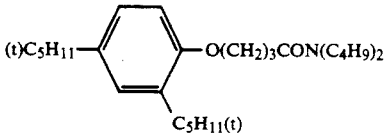

(c-5)

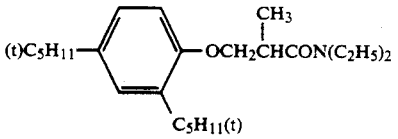

(c-6)

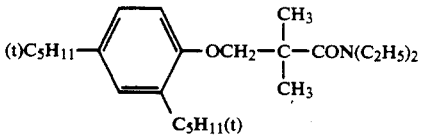

(c-7)

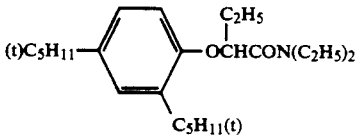

In addition to the above exemplified compounds, use may be made of compounds described on pages 166–210 of the specification of Japanese Patent O.P.I. Publication No. 166339/1987 and on pages 9–20 of the specification of Japanese Patent O.P.I. Publication No. 254149/1987.

It is preferred that the compounds respectively represented by Formulas [a] to [c] be incorporated in a silver halide layer containing the foregoing coupler. These may be incorporated singly or in combination with a coupler in the form of dispersion, within a limit not injurious to the effect of the invention.

In the invention, the compound represented by the following Formula [III] is preferably used in order to stabilize magenta dye images. The compound may be added to a layer containing a magenta coupler and/or a layer adjacent thereto, in an amount of 5 to 400 mol% of magenta coupler, preferably 10 to 250 mol%.

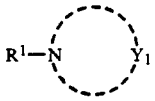

Formula [III]

wherein $R^1$ represents an aliphatic, cycloalkyl, aryl or heterocyclic group; $Y_1$ represents a group of non-metal atoms necessary to form, in conjunction with the nitrogen atom, a morpholine or thiomorpholine ring.

In Formula [III], $R^1$ represents an aliphatic, cycloalkyl, aryl or heterocyclic group. The aliphatic group represented by $R^1$ includes alkyl groups such as methyl, ethyl, butyl, octyl, dodecyl tetradecyl and hexadecyl; alkynyl groups such as ethenyl and propenyl; and alkenyl groups such as ethynyl and propenyl. Each of them may have a substituent.

The cycloalkyl group represented by $R^1$ includes five- to seven-membered cycloalkyl groups such as cyclopentyl and cyclohexyl, and they may have a substituent.

The aryl group represented by $R^1$ includes phenyl and naphthyl groups, each of which may have a substituent.

The heterocyclic group represented by $R^1$ includes 2-pyridyl-1,4-piperidyl, 2-furyl, 2-thienyl and 2-pyrimidyl groups, each of them may have a substituent.

The substituent of the aliphatic, cycloalkyl, aryl and heterocyclic groups represented by $R^1$ includes alkyl, aryl, alkoxy, carbonyl, carbamoyl, acylamino, sulfamoyl, sulfonamide, carbonyloxy, alkylsulfonyl, arylsulfonyl, hydroxy, heterocyclic, alkylthio and arylthio groups. These groups may further possess a substituent.

In the foregoing Formula [III], $Y_1$ represents a group of non-metallic atoms necessary to form a morpholine ring or thiomorpholine ring jointly with a nitrogen atom. Said morpholine ring or thiomorpholine ring may have a substituent such as alkyl, cycloalkyl, aryl and heterocyclic group.

Examples of the compounds represented by Formula [III] are illustrated below. But the scope of the invention is not limited to these examples.

III-1

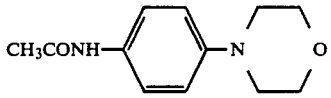

III-2

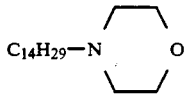

III-3

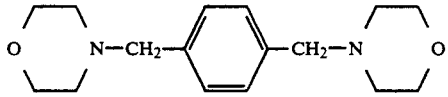

III-4

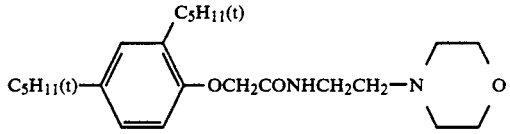

III-5

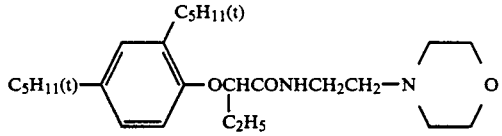

III-6

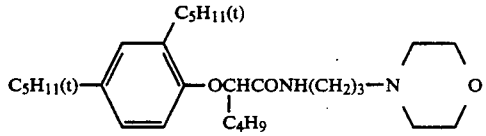

III-7

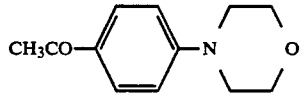

III-8

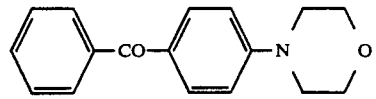

-continued
III-9
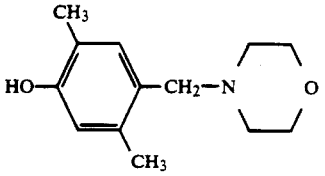
III-10
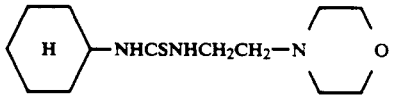
III-11
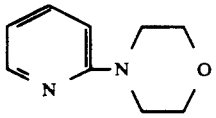
III-12
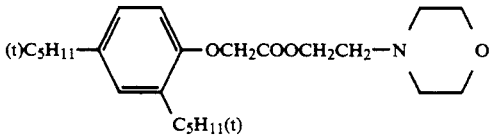
III-13
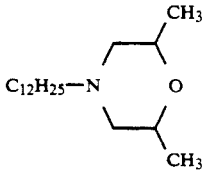
III-14
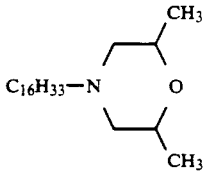
III-15
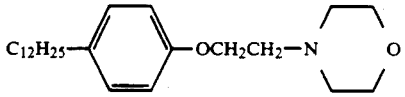
III-16
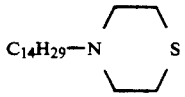
III-17
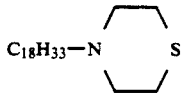
III-18
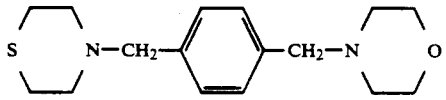
III-19
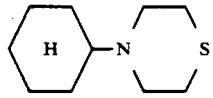

-continued

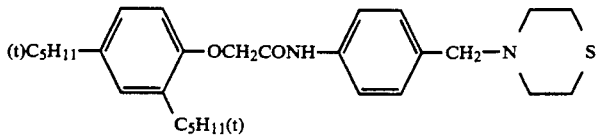

III-20

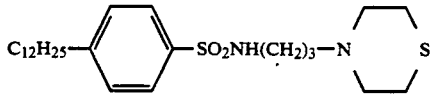

III-21

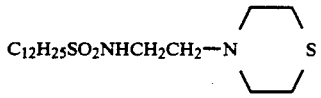

III-22

In the invention, it is preferred that the compound represented by Formula [IV] be used to improve light fastness.

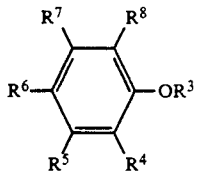

Formula [IV]

wherein $R^3$ represents a hydrogen atom, or an alkyl, alkenyl, aryl or heterocyclic group; $R^4$, $R^5$, $R^7$ and $R^8$ independently represent a hydrogen or halogen atom, or a hydroxy, alkyl, alkenyl, aryl, alkoxy or acylamini group; $R^6$ represents an alkyl, hydroxy, aryl or alkoxy group; $R^3$ and $R_4$ may be linked to close a ring and form a five- or six-membered ring provided that $R^6$ is a hydroxy or alkoxy group, and further, $R^3$ and $R^4$ may close to form a methylenedioxy ring; moreover, $R^5$ and $R^6$ may close to form a five-membered hydrocarbon ring when $R^3$ is an alkyl, aryl or heterocyclic group, except the case that $R^3$ is a hydrogen atom and $R^6$ is a hydroxy group.

Preferred examples of the compound represented by Formula [IV] are shown below:

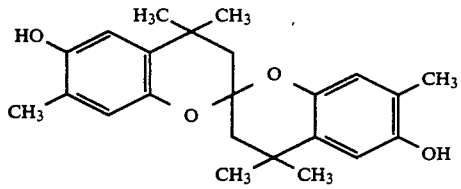

IV-1

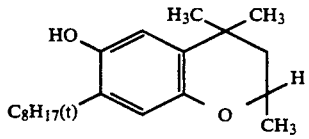

IV-2

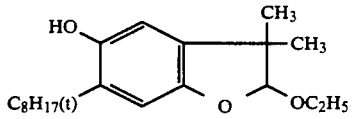

IV-3

-continued

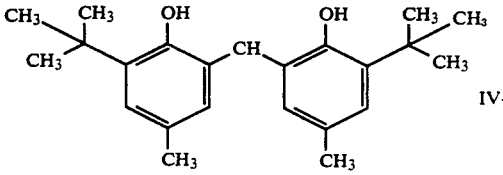

IV-4

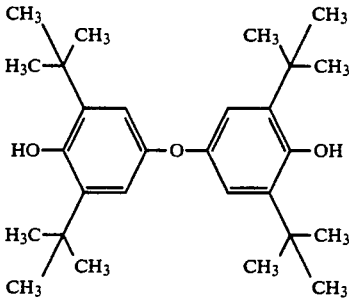

IV-5

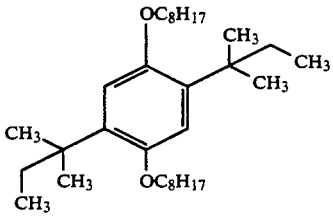

IV-6

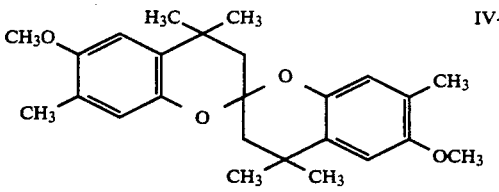

IV-7

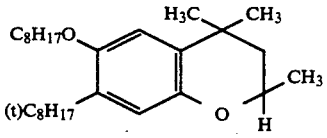

IV-8

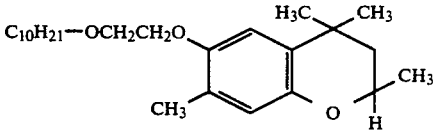

IV-9

-continued

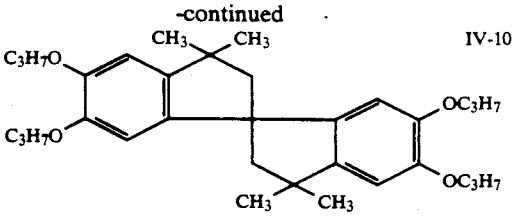

IV-10

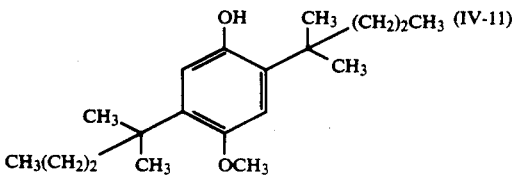

(IV-11)

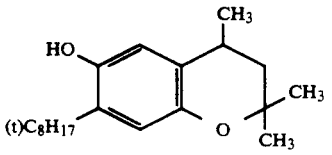

IV-12

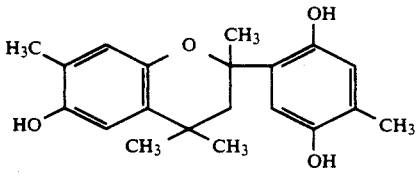

IV-13

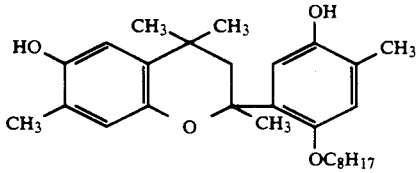

IV-14

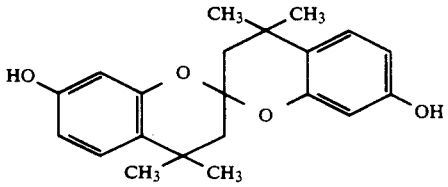

IV-15

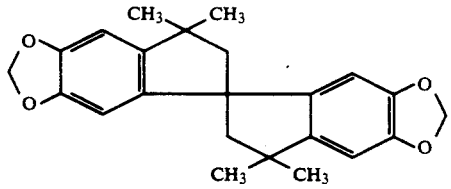

IV-16

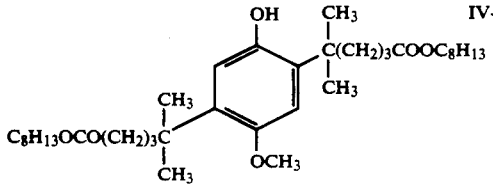

IV-17

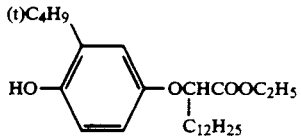

IV-18

-continued

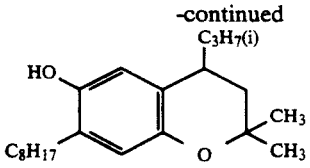

IV-19

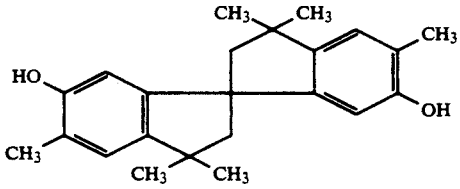

IV-20

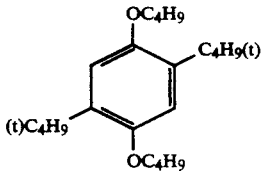

IV-21

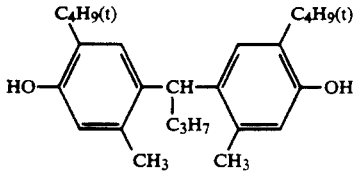

IV-22

These phenol compounds and phenylether compounds represented by Formula [IV] are preferably used in an amount of $1\times10^{-2}$ to 5 mol, more preferably $1\times10^{-1}$ to 2 mol per mol of magenta coupler. In this case, addition to a magenta-coupler-containing layer is preferred.

In the invention, use of the compound represented by the following Formula [V] is preferred for a further improvement of fastness of magenta dye images.

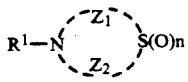

Formula [V]

wherein $R^1$ represents an aryl or heterocyclic group; $Z_1$ and $Z_2$ independently represent an alkylene group having 1 to 3 carbon atoms, provided that the total number of carbon atoms in said alkylene groups ranges from 3 to 6; and n represents 1 or 2.

The addition amount of the compound is preferably 5 to 400 mol% of a magenta coupler, more preferably 10 to 300 mol% of a magenta coupler.

In the above Formula [V], the aryl group represented by $R^1$ includes phenyl and 1-naphthyl groups. These aryl groups may have a substituent; examples thereof include those which are previously defined as the substituents of R in Formula [M-I].

The heterocyclic group represented by $R^1$ includes 2-furyl and 2-thienyl groups, which may have a substituent defined as the substituent of R in Formula [M-I].

$Z_1$ and $Z_2$ individually represent an alkylene group having 1 to 3 carbon atoms, and the total number of carbon atoms in the alkylene groups represented by $Z_1$ and $Z_2$ is 3 to 6. These alkylene groups may respectively possess a substituent defined as the substituent of R in Formula [M-I].

n represents 1 or 2.

Among the compounds represented by Formula [V], the particularly preferred are those in which $R^1$ is a phenyl group, each of $Z_1$ and $Z_2$ is an ethylene group, and n is 2.

Examples of the compound represented by Formula [V] are illustrated below:

V-1

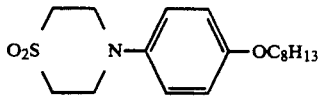

V-2

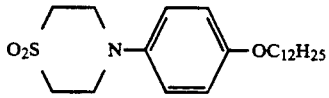

V-3

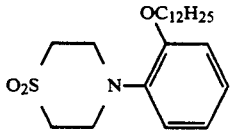

V-4

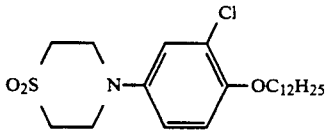

V-5

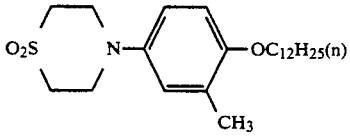

V-6

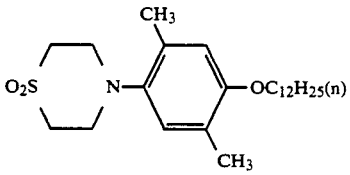

V-7

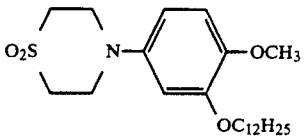

V-8

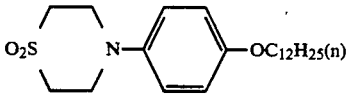

V-9

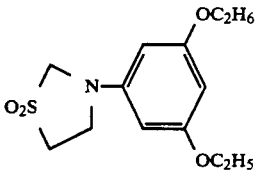

V-10

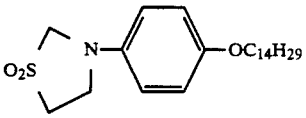

In the silver halide photographic light-sensitive material of the invention, it is preferred that at least one of the compounds represented by the following Formula [VI] be contained at least in one of the silver halide emulsion layers.

Formula [VI]

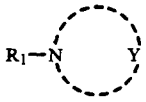

wherein $R_1$ represents an aliphatic, cycloalkyl or aryl group; and Y represents a group of non-metallic atoms necessary to form a five- to seven-membered heterocycle jointly with a nitrogen atom, provided that at least two of non-metallic atoms including the nitrogen atom forming said heterocycle are heteroatoms and that said two heteroatoms are not adjacent to each other.

The preferred addition amount of the compound is 5 to 500 mol% of a magenta coupler; the particularly preferred is 10 to 300 mol%.

The aliphatic group represented by $R_1$ in Formula [VI] is a saturated alkyl or an unsaturated alkenyl or alkynyl group, each of which may have a substituent. Examples of the alkyl group include methyl, ethyl, butyl, octyl, dodecyl, tetradecyl and hexadecyl groups; and examples of the unsaturated group include ethenyl and propenyl groups.

The cycloalkyl group represented by $R_1$ is a five- to seven-membered cycloalkyl group such as cyclopentyl and cyclohexyl.

The aryl group represented by $R_1$ is a phenyl or naphthyl group, which may have a substituent.

Examples of the substituent of the aliphatic, cycloalkyl and aryl groups represented by $R_1$ include alkyl, aryl, alkoxy, carbonyl, carbamoyl, acylamino, sulfamoyl, sulfonamide, carbonyloxy, alkylsulfonyl, arylsulfonyl, hydroxy, heterocyclic, alkylthio and arylthio groups. These substituents may further have a substituent.

Y in Formula [VI] represents a group of non-metallic atoms necessary to form a five- to seven-membered heterocycle together with a nitrogen atom; where at least two of non-metallic atoms including the nitrogen atom forming said heterocycle must be heteroatoms, and said at least two heteroatoms must not be adjacent to each other. In case that all the heteroatoms in the heterocycle represented by Formula [VI] are adjacent to each other, the function to stabilize magenta dye images cannot be performed.

The five- to seven-membered heterocycle represented by Formula [VI] may have a substituent such as alkyl, aryl, acyl, carbamoyl, alkoxycarbonyl, sulfonyl and sulfamoyl groups. These substituents may further have a substituent. The above five- to seven-membered heterocycle may be saturated, but an unsaturated heterocycle is preferred. Further, a benzene ring may be condensed with said heterocycle, or a spiro-ring may be formed.

Examples of the compound represented by Formula [VI] will be illustrated bellow. These compounds are used preferably in a layer containing magenta couplers and/or a layer adjacent thereto.

(1)

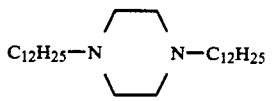

-continued (2)

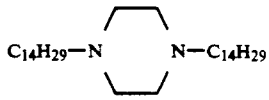

(3)

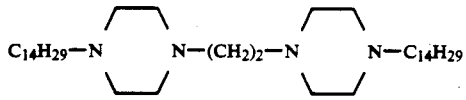

(4)

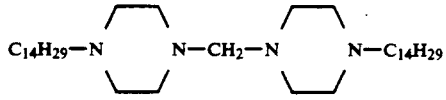

(5)

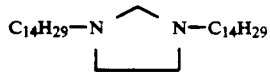

In the invention, it is preferred that the following compounds be used in combination with the coupler of the invention as a compound to improve color tone by altering spectral absorption of a dye formed, by incorporating through steps of dispersing it together with the coupler and then adding the dispersion to a light-sensitive material of the invention. These compounds are represented by the following Formulas [d-I] to [d-IV] and described in Japanese Patent O.P.I. Publication Nos. 167357/1988, 167358/1988, 231340/1988 and 256952/1988.

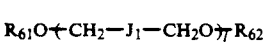

Compound [d-I]

wherein $R_{61}$ and $R_{62}$ independently represent an aliphatic group or —COR′ (R′ represents an aliphatic group); $J_1$ represents a univalent organic group or a mere linkage; and l represents an integer of 0 to 6.

A compound having two or more 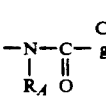 groups

Compound [d-II]

wherein $R_A$ represents an alkyl, alkenyl or aryl group.

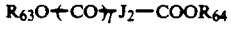

Compound [d-III]

wherein $R_{63}$ and $R_{64}$ independently represent an aliphatic or nitrogen-containing heterocycle group; $J_2$ represents a bivalent organic group; and l represents 0 or 1.

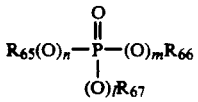

Compound [d-IV]

wherein $R_{65}$, $R_{66}$ and $R_{67}$ independently represent an aliphatic or aromatic group; and l, m and n independently represent 0 or 1, provided that l, m and n are not 1 concurrently.

Examples of the aliphatic group represented by $R_{61}$ and $R_{62}$ in Compound [d-I] include alkyl groups having 1 to 32 carbon atoms, and alkenyl, alkynyl, cycloalkyl and cycloalkenyl groups. The alkyl, alkenyl and alkynyl groups may be straight-chained or branched, and may have a substituent.

Further, R′ in —COR′ represents an aliphatic group, and examples thereof include the same groups as those specified with respect to $R_{61}$ and $R_{62}$.

The bivalent organic group represented by $J_1$ includes alkyl, cycloalkyl, carbonyl and carbonyloxy groups, which may have a substituent.

Preferred examples of Compound [d-II] are those expressed by the following Formulas [1] to [4]:

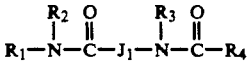

Formula [1]

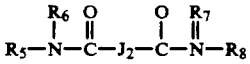

Formula [2]

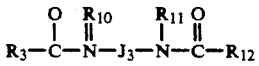

Formula [3]

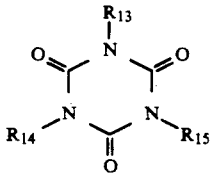

Formula [4]

wherein $R_1$, $R_2$, $R_3$, $R_5$, $R_6$, $R_6$, $R_7$, $R_8$, $R_{10}$, $R_{11}$, $R_{13}$, $R_{14}$ and $R_{15}$ individually represent an alkyl, alkenyl or aryl group; $R_4$, $R_9$ and $R_{12}$ independently represent an alkyl, alkenyl aryl, alkoxy or

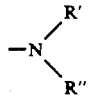

group (R′ and R″ independently represent a hydrogen atom or an alkyl group); and $J_1$, $J_2$ and $J_3$ independently represent a bivalent organic group.

In Compound [d-III], examples of the aliphatic group represented by $R_{63}$ and $R_{64}$ include alkyl groups having 1 to 32 carbon atoms, and alkenyl, alkynyl, cycloalkyl and cycloalkenyl groups. These alkyl, alkenyl and alkynyl groups may be straight-chained or branched, and may have a substituent.

Examples of the nitrogen-containing heterocycle represented by $R_{63}$ and $R_{64}$ include pyrrolyl, pyrazolyl, imidazolyl, pyridyl, imidazolinyl, piperazinyl and piperidinyl groups, these may have a substituent.

The bivalent organic group represented by $J_2$ is an alkylene, alkenylene, cycloalkylene, carbonyl or carbonyloxy group. These groups include ones having a substituent.

Examples of the aliphatic group represented by $R_{65}$, $R_{66}$ and $R_{67}$ in Compound [d-IV] include alkyl groups having 1 to 32 carbon atoms, and alkenyl, alkynyl, cycloalkyl and cycloalkenyl groups. The alkyl, alkenyl and alkynyl groups may be straight-chained or branched; they may have a substituent.

Examples of the aromatic group represented by $R_{65}$, $R_{66}$ and $R_{67}$ include aryl and aromatic heterocycle groups, and preferred examples are aryl groups. These aromatic groups include those having a substituent.

Examples of the compounds represented by Formulas [d-I] to [d-IV] will be illustrated below:

$$C_4H_9\underset{\underset{C_2H_5}{|}}{C}HCOOCH_2CH_2OCO\underset{\underset{C_2H_5}{|}}{C}HC_4H_9 \quad \text{(d-1)}$$

$$C_4H_9\underset{\underset{C_2H_5}{|}}{C}HCH_2O(CH_2)_6OCH_2\underset{\underset{C_2H_5}{|}}{C}HC_4H_9 \quad \text{(d-2)}$$

$$(C_4H_9\underset{\underset{C_2H_5}{|}}{C}HCOOCH_2)_3CCO\underset{\underset{C_2H_5}{|}}{C}HC_4H_9 \quad \text{(d-3)}$$

(d-4)

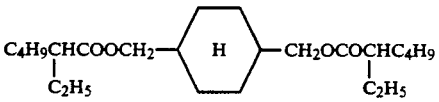

$$[(i)C_3H_7]_2NOCCH_2\overset{\overset{CON(C_3H_7)_2}{|}}{\underset{\underset{CON(C_3H_7)_2}{|}}{C}}HCHCH_2CON[C_3H_7(i)]_2 \quad \text{(d-5)}$$

$$C_2H_5-\overset{\overset{C_2H_5}{|}}{N}OC\underset{\underset{C_8H_{17}}{|}}{C}HCH_2\overset{\overset{C_2H_5}{|}}{N}COOC_2H_5 \quad \text{(d-6)}$$

$$CH_3CO-\overset{\overset{C_8H_{17}}{|}}{N}CH_2CH_2\overset{\overset{C_8H_{17}}{|}}{N}-COCH_3 \quad \text{(d-7)}$$

(d-8)

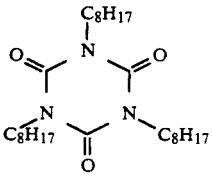

$$C_8H_{17}OCO(CH_2)_8COOC_8H_{17} \quad \text{(d-9)}$$

$$C_4H_9\underset{\underset{C_2H_5}{|}}{C}HCH_2OCO\overset{\overset{OCOCH_3}{|}}{C}HCH_2COOCH_2\underset{\underset{C_2H_5}{|}}{C}HC_4H_9 \quad \text{(d-10)}$$

$$(n\text{-}c_8H_{17}O)_2\underset{\underset{C_8H_{17}(n)}{|}}{P}=O \quad \text{(d-11)}$$

$$(n\text{-}C_6H_{13})_3P=O \quad \text{(d-12)}$$

$$[(i)C_3H_7]_2NOCCH_2\overset{\overset{CON(C_3H_7)_2}{|}}{\underset{\underset{CON(C_3H_7)_2}{|}}{C}}HCHCH_2CON[C_3H_7(i)]_2 \quad \text{(d-5)}$$

$$C_2H_5-\overset{\overset{C_2H_5}{|}}{N}OC\underset{\underset{C_8H_{17}}{|}}{C}HCH_2\overset{\overset{C_2H_5}{|}}{N}COOC_2H_5 \quad \text{(d-6)}$$

$$CH_3CO-\overset{\overset{C_8H_{17}}{|}}{N}CH_2CH_2\overset{\overset{C_8H_{17}}{|}}{N}-COCH_3 \quad \text{(d-7)}$$

-continued (d-8)

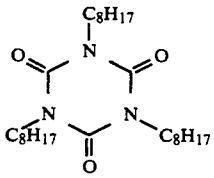

$$C_8H_{17}OCO(CH_2)_8COOC_8H_{17} \quad \text{(d-9)}$$

$$C_4H_9\underset{\underset{C_2H_5}{|}}{C}HCH_2OCO\overset{\overset{OCOCH_3}{|}}{C}HCH_2COOCH_2\underset{\underset{C_2H_5}{|}}{C}HC_4H_9 \quad \text{(d-10)}$$

$$(n\text{-}C_8H_{17}O)_2\underset{\underset{C_8H_{17}(n)}{|}}{P}=O \quad \text{(d-11)}$$

$$(n\text{-}C_6H_{13})_3P=O \quad \text{(d-12)}$$

$$(n\text{-}C_8H_{17})_3P=O \quad \text{(d-13)}$$

$$(n\text{-}C_4H_9\underset{\underset{C_2H_5}{|}}{C}HCH_2)_3P=O \quad \text{(d-14)}$$

In addition to the above exemplified compounds, the compounds expressed by Formulas [d-I] to [d-IV] include those described on pages 32–43 of the specification of Japanese Patent O.P.I. Publication 167357/1988, pages 32–39 of the specification of Japanese Patent O.P.I. Publication 167358/1988, pages 32–40 of the specification of Japanese Patent O.P.I. Publication 231340/1988 and pages 28–42 of the specification of Japanese Patent O.P.I. Publication 256952/1988.

The addition amount of the compounds represented by Formulas [d-I] to [d-IV] to a light-sensitive material is preferably 5 to 500 mol% of an amount of coupler used, more preferably 10 to 300 mol%.

In the invention, there may be used a compound represented by Formula [A'] in combination with the compounds expressed by the foregoing Formulas [d-I] to [d-IV].

$$R'_1-NHSO_2-R'_2 \quad \text{Formula A}$$

In the Formula, $R'_1$ and $R'_2$ independently represent an alkyl or aryl group, which may possess a substituent. And at least one of $R'_1$ and $R'_2$ is preferably an aryl group, more preferably a phenyl group. The most preferred mode is that both $R'_1$ and $R'_2$ are aryl groups, particularly phenyl groups. When $R'_1$ is a phenyl group, it is particularly preferred that the Hammett's op value of a substituent on the para position of the sulfonamide group be larger than −0.4.

Examples of the alkyl group represented by $R'_1$ and $R'_2$ include alkyl groups having 1 to 32 carbon atoms, such as methyl, ethyl, butyl, nonyl and decyl groups.

Preferable examples of the aryl group represented by $R'_1$ and $R'_2$ are substituted phenyl groups. The preferable substituents are halogen atoms such as chlorine, bromine and fluorine; alkoxy groups such as methoxy, butoxy and dodecyloxy groups; and alkyl groups such as methyl, butyl and dodecyl groups.

Typical examples of the compounds represented by Formula [A'] are shown hereunder.

(A'-1)

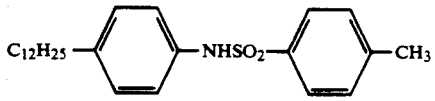

(A'-2)

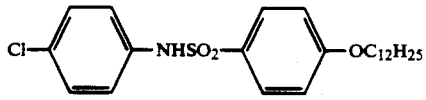

(A'-3)

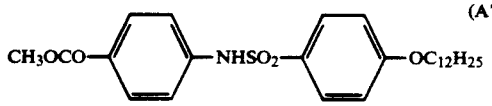

(A'-4)

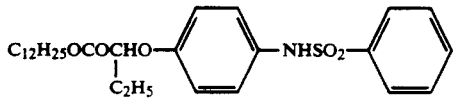

(A'-5)

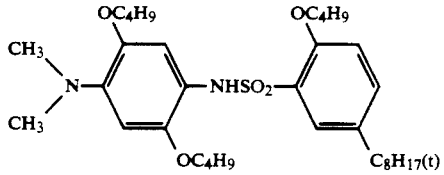

(A'-6)

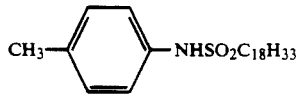

(A'-7)

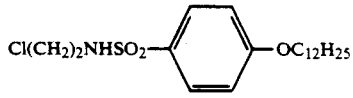

In the silver halide photographic material of the invention, there may be employed conventional sensitizing dyes. These dyes include cyanine dyes having, as the two basic mother nuclei, condensed benzene rings or condensed naphthalene rings such as thiazole rings, selenazole rings, oxazole rings or imidazole rings; merocyanine dyes having the above basic mother nucleus and an acid mother nucleus such as a rhodanine ring, thiohydantoin ring, 2-thioselenazoline-2,4-dion ring or barbituric ring; and three-nucleus complex merocyanine dyes having three mother nuclei. Among them, cyanine dyes can be advantageously used because of their capability of providing a high sensitivity and large effect in reducing residual dye stain which is intended by the invention.

These sensitizing dyes may be used in combination according to a required spectral distribution.

Examples of the preferred sensitizing dyes are shown below:

BS-1

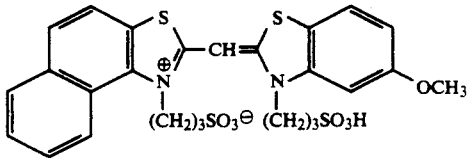

BS-2

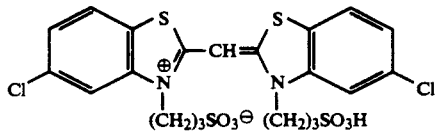

BS-3

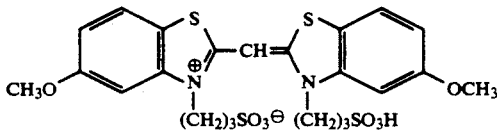

BS-4

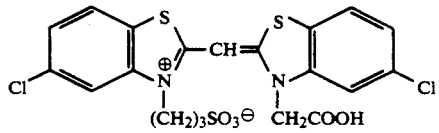

BS-5

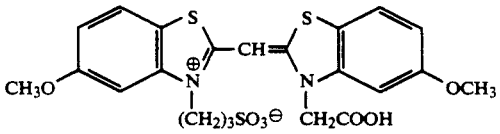

BS-6

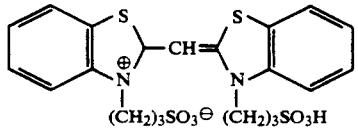

BS-7

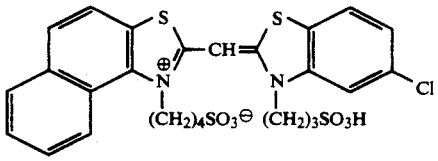

BS-8

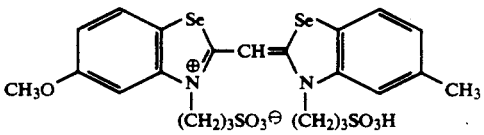

BS-9

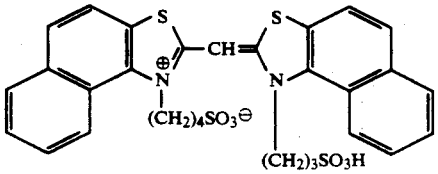

Examples of the preferred green-sensitive sensitizing dyes include the following compounds:

GS-1
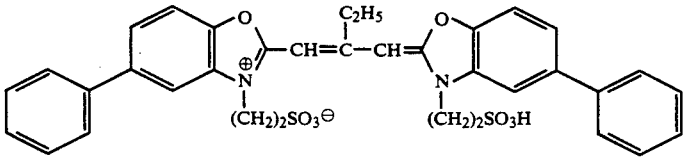
GS-2
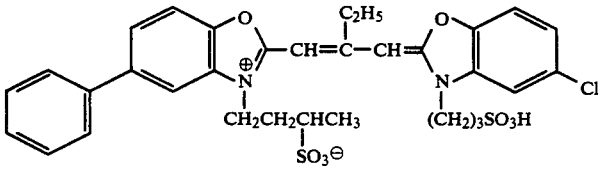
GS-3
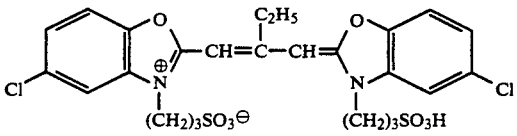
GS-4
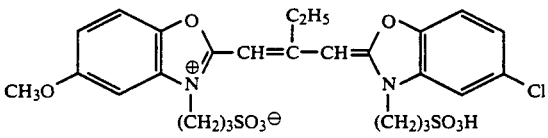
GS-5
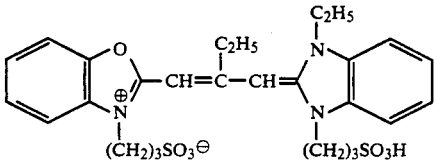
Examples of the preferred red-sensitive sensitizing dyes include the following compounds:
RS-1
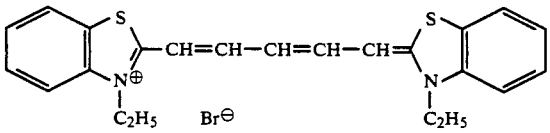
RS-2
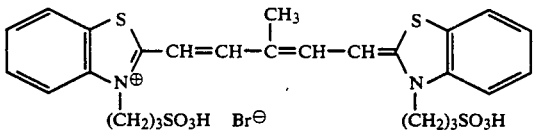
RS-3
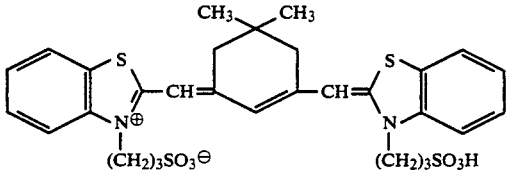
RS-4
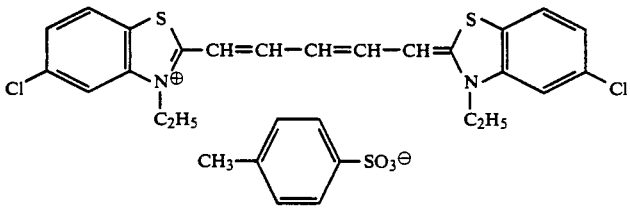

-continued

RS-5

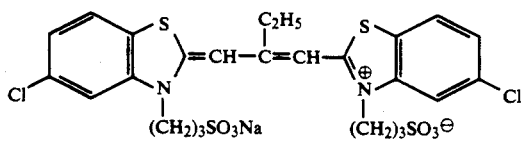

RS-6

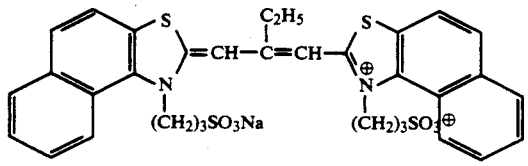

RS-7

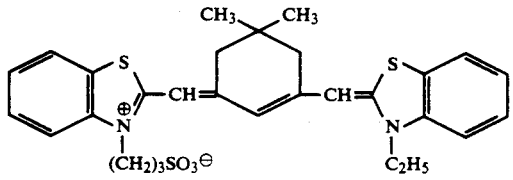

RS-8

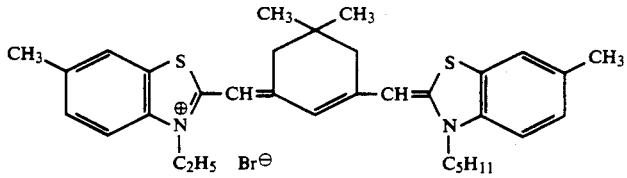

The above sensitizing dyes are conventional ones, and can be readily prepared by methods described, for example, in British Patent No. 660,408, U.S. Pat. No. 3,149,105, Japanese Patent O.P.I. Publication No. 4127/1975 and "The Cyanine Dyes and Related Compounds", by Hammer (Interscience Publishers, New York, 1969).

In the silver halide photographic light-sensitive material of the invention, various types of surfactant are favorably used to emulsify a coupler into a dispersion and adjust the surface tension of a coating solution for optimum coating. While conventional surfactants may be selected according to specific purposes, the compound represented by the following Formula [e-I] is particularly preferred because of its capability of preventing deterioration in whiteness owing to residual sensitizing dyes.

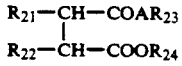

Formula [e-I]

wherein one of $R_{21}$ and $R_{22}$ represents a hydrogen atom and the other is a group represented by the formula $-SO_3M$ (M is a univalent positive ion); A represents an oxygen atom or a group expressed by the formula $-NR_{25}-$ ($R_{25}$ is a hydrogen atom or alkyl group having 1 to 8 carbon atoms); and $R_{23}$ and $R_{24}$ independently represent an alkyl group having 4 to 16 carbon atoms.

Typical examples of the compound represented by Formula [e-I] are as follows:

(e-1)

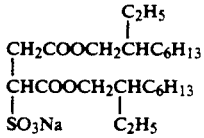

-continued (e-2)

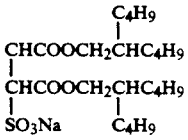

(e-3)

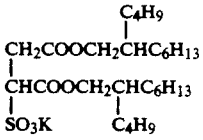

(e-4)

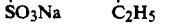

(e-5)

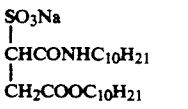

(e-6)

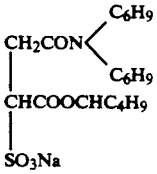

(e-7)

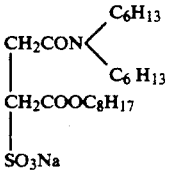

-continued $CH_2COOC_8H_{17}$
|
$CH_2COOC_8H_{17}$
|
$SO_3Na$ (e-8)

$C_2H_5$
|
$CH_2COOC_6H_{12}CHCH_3$
|
$CHCOOC_6H_{12}CHCH_3$
|
$SO_3Na$ $C_2H_5$ (e-9)

$CH_2COOCH_2(CF_2CF_2)_2H$
|
$CHCOOCH_2(CF_2CF_2)_2H$
|
$SO_3Na$ (e-10)

While the addition amount of the compounds represented by Formula [e-I] is varied depending upon the amount of oily matters or that of gelatin contained in a light-sensitive material, these are preferably used in an addition amount of $1.5\times10^{-5}$ to $1.5\times10^{-3}$ mol/m$^2$, more preferably $6.5\times10^{-5}$ to $1.6\times10^{-4}$ mol/m$^2$.

The silver halide photographic light-sensitive material of the invention may contain dyes having absorptions in various wavelength regions, for the purposes of anti-irradiation, antihalation and adjustment of sensitivities. Any of conventional compounds for these purposes may be employed; but, the following compounds are preferred because of their noticeable effect in reducing residual dye stain.

| | $R_1$ | $R_2$ | $R_3$ | $R_4$ | m |
|---|---|---|---|---|---|
| | 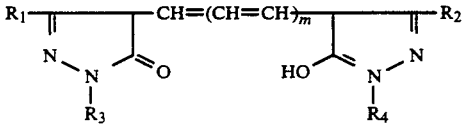 | | | | |
| AI - 1 | 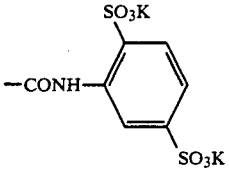 | The same as $R_1$ | $-CH_3$ | The same as $R_3$ | 2 |
| AI - 2 | $-CONH(CH_2)_2OH$ | The same as $R_1$ | 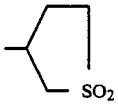 | The same as $R_3$ | 2 |
| AI - 3 | $-CONH(CH_2)_2OH$ | The same as $R_1$ | 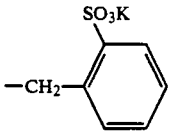 | The same as $R_3$ | 2 |
| AI - 4 | 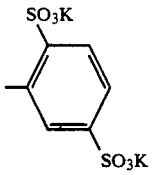 | The same as $R_1$ | $-COCH_3$ | The same as $R_3$ | 2 |
| AI - 5 | $-COOC_2H_6$ | The same as $R_1$ | 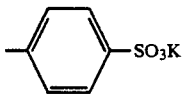 | The same as $R_3$ | 2 |
| AI - 6 | $-CONH_2$ | The same as $R_1$ | 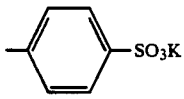 | The same as $R_3$ | 1 |
| AI - 7 | $-COOH$ | The same as $R_1$ | 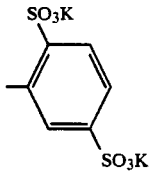 | The same as $R_3$ | 1 |

-continued

| | $R_1$ | $R_2$ | $R_3$ | $R_4$ | m |
|---|---|---|---|---|---|
| AI - 8 | $-CH_3$ | The same as $R_1$ | 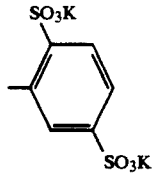 | The same as $R_3$ | 0 |
| AI - 9 | $-CH_3$ | The same as $R_1$ | 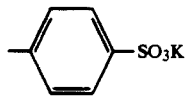 | The same as $R_3$ | 0 |
| | 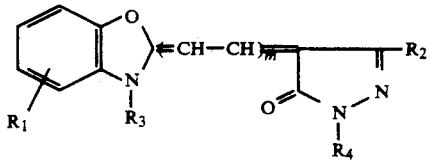 | | | | |
| AI - 10 | $-SO_3K$ | $-CH_3$ | $-C_2H_5$ | 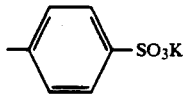 | 2 |
| AI - 11 | $-H$ | $-COCH_3$ | 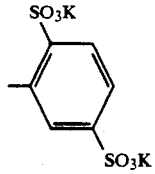 | The same as $R_3$ | 1 |

The supports used in the silver halide photographic light-sensitive material of the invention include flexible reflective supports such as papers and synthetic papers each coated with olefin polymer (for example, polyethylene, polypropylene, ethylene-butene copolymer, etc.); flexible films made of semi-synthetic or synthetic polymers such as cellulose acetate, polystyrene, polyvinylchloride, polyethylene terephthalate and polyamide; flexible supports prepared by providing, on the above films, a reflective layer such as a gelatin layer containing a white pigment like titanium dioxide; films having a white light reflectivity which are prepared by incorporating white pigments such as barium sulfate and titanium dioxide or making holes in a film; and glass and ceramics.

In the silver halide photographic light-sensitive material of the invention, there may be arbitrarily used an antistain agent, hardener, plasticizer, polymer latex, ultraviolet absorbent, formalin scavenger, mordant, developing accelerator, developing retarder, optical brightener, matting agent, slipping agent, antistatic agent, surfactant, etc.

Gelatin is advantageously used as a binder in the silver halide photographic light-sensitive material of the invention.

According to a specific requirement, however, use is made of other hydrophilic colloids such as gelatin derivatives, graft polymers of gelatin and other polymers, proteins, sugar derivatives, cellulose derivatives, and synthetic hydrophilic polymers including homopolymers and copolymers.

In the silver halide light-sensitive material of the invention, photographic component layers may be coated, directly or via a subbing layer (one or more subbing layers to enhance adhesion, antistatic capability, dimensional stability, abrasion resistance, hardness, antihalation capability, rubbing characteristics and/or other characteristics), on a support of which surface is subjected to corona discharge, ultraviolet irradiation or flame treatment as occasion demands.

In coating a silver halide emulsion of the invention, a thickener may be used to improve coating property of the emulsion. The preferred coating methods are extrusion coating and curtain coating, both of which are capable of coating two or more layers simultaneously.

The silver halide photographic light-sensitive material of the invention forms an image when subjected to color development known in the art.

The preferred developing agents used in a color developer for the silver halide light-sensitive material of the invention include aminophenol derivatives and p-phenylenediamine derivatives which are widely used in a variety of color photographic processes.

In a color developer for the silver halide light-sensitive material of the invention, conventional developer components may be used in addition to the foregoing aromatic primary amine color developing agents.

The silver halide photographic light-sensitive material of the invention is subjected to bleaching and fixing after developing. Bleaching may be performed simultaneously with fixing. After fixing, washing is usually performed; stabilization may be carried out instead of washing.

The developing equipment used in development of the silver halide photographic light-sensitive material of the invention may be any of a roller transport type where a light-sensitive material is transported while being held between rollers arranged in the processing tank, an endless belt type where a light-sensitive material is transported while being fastened to the belt, and a type where the processing tank takes the form of a slit to which a light-sensitive material is transported while a processing solution is supplied.

EXAMPLES

The present invention will be hereunder described with examples, but the scope of the invention is not limited to these examples.

EXAMPLE 1

On a paper support laminated with polyethylene on one side and with polyethylene containing titanium dioxide on the other side (the side on which photographic structural layers are to be formed), the following layers were coated to prepare a multilayer silver halide color photographic light-sensitive material, Sample-101. The coating solutions used were prepared as follows:

Coating solution for the 1st layer

There were dissolved 26.7 g of a yellow coupler (the above Y-8), 10.0 g of a dye image stabilizer (the above a-7), 6.67 g of the above c-1 and 0.67 g of an antistain agent (HQ-1) in 6.67 g of a high boiling solvent (DNP) while adding 60 ml of ethyl acetate thereto, the solution was emulsified with a ultrasonic homogenizer in 220 ml of 10% aqueous gelatin solution containing 7 ml of a 20% surfactant (SU-1) to obtain a yellow coupler dispersion, the dispersion was then mixed with a blue-sensitive silver halide emulsion (8.68 g of silver), followed by addition of an anti-irradiation dye, AI-9 (6.7 ml of 5% solution) to prepare a coating solution for 1st layer.

Coating solutions for the 2nd to 7th layers were prepared likewise.

The constitution of the above was that shown in Table 1.

TABLE 1

| Layer | Constituent | Amount added (g/m$^2$) |
|---|---|---|
| 7th layer (protective layer) | Gelatin | 1.0 |
| 6th layer (ultraviolet absorbing layer) | Gelatin | 0.4 |
| | UV absorbent (UV-1) | 0.02 |
| | UV absorbent (UV-2) | 0.04 |
| | UV absorbent (UV-3) | 0.02 |
| | Antistain agent (HQ-1) | 0.01 |
| | DNP | 0.1 |
| | Anti-irradiation dye (AI-2) | 0.02 |
| 5th layer (red-sensitive layer) | Gelatin | 1.30 |
| | Red-sensitive silver chlorobromide emulsion (Em C) as converted into silver | 0.21 |
| | Cyan coupler (the above CC-3) | 0.17 |
| | Cyan coupler (the above CC-8) | 0.25 |
| | dye image stabilizer (the above a-7) | 0.20 |
| | Antistain agent (HQ-1) | 0.01 |
| | The above A'-1 | 0.20 |
| | DOP | 0.20 |
| 4th layer (ultraviolet absorbing layer) | Gelatin | 0.94 |
| | UV absorbent (UV-1) | 0.04 |
| | UV absorbent (UV-2) | 0.08 |
| | UV absorbent (UV-3) | 0.04 |
| | Antistain agent (HQ-1) | 0.03 |
| | DNP | 0.20 |

TABLE 1-continued

| Layer | Constituent | Amount added (g/m$^2$) |
|---|---|---|
| 3rd layer (green-sensitive layer) | Gelatin | 1.40 |
| | Green-sensitive silver chlorobromide emulsion (Em B) as converted into silver | 0.17 |
| | Magenta coupler (the above M-63) | 0.35 |
| | Dye image stabilizer (the above IV-21) | 0.15 |
| | Dye image stabilizer (the above V-1) | 0.15 |
| | Dye image stabilizer (the above IV-22) | 0.15 |
| | DNP | 0.20 |
| | Anti-irradiation dye (the above AI-7) | 0.01 |
| 2nd layer (intermediate layer) | Gelatin | 1.20 |
| | Antistain agent (HQ-2) | 0.12 |
| | DIDP | 0.15 |
| 1st layer (blue-sensitive layer) | Gelatin | 1.20 |
| | Blue-sensitive silver chlorobromide emulsion (Em A) as converted into silver | 0.26 |
| | Yellow coupler (the above Y-8) | 0.80 |
| | Dye image stabilizer (the above a-7) | 0.30 |
| | Dye image stabilizer (the above c-1) | 0.20 |
| | Antistain agent (HQ-1) | 0.02 |
| | Anti-irradiation dye (the above AI-9) | 0.01 |
| | DNP | 0.20 |
| Support | Polyethylene-laminated paper | |

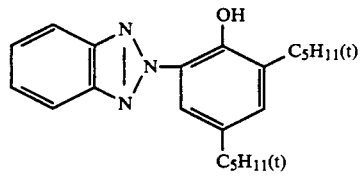

UV-1

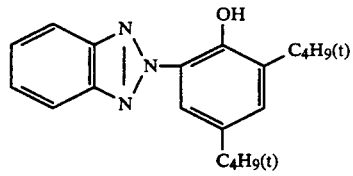

UV-2

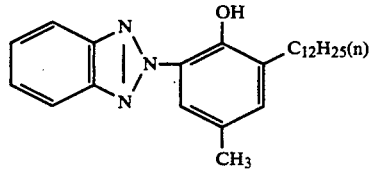

(UV-3)

DOP: dioctyl phthalate DNP: dinonyl phthalate
DIDP: diisodecyl phthalate

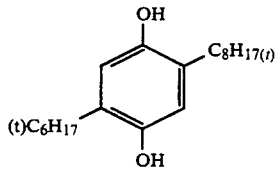

HQ-1

-continued

HQ-2

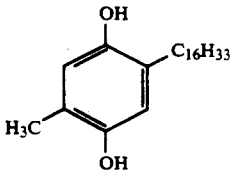

SU-1

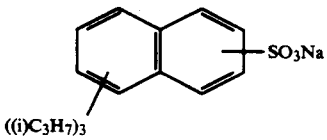

As a hardener, the following H-1 was used.

H-1

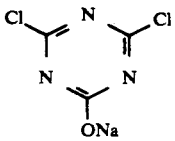

[Preparation of a blue-sensitive silver halide emulsion]

To 1,000 ml of a 2% aqueous gelatin solution kept at 40° C. were simultaneously added the following Solution A and solution B over a period of 30 minutes while controlling pAg at 6.5 and pH at 3.0, and then the following Solution C and Solution D were added thereto over a period of 180 minutes while controlling pAg at 7.3 and pH at 5.5.

The control of pAg was performed according to the method described in Japanese Patent O.P.I. Publication No. 45437/1984, and pH was controlled with the addition of sulfuric acid or an aqueous solution of sodium hydroxide.

| | |
|---|---|
| Solution A | |
| Sodium chloride | 3.42 g |
| Potassium bromide | 0.03 g |
| Water was added to | 200 ml |
| Solution B | |
| Silver nitrate | 10 g |
| Water was added to | 200 ml |
| Solution C | |
| Sodium chloride | 102.7 g |
| Potassium bromide | 1.0 g |
| Water was added to | 600 ml |
| Solution D | |
| Silver nitrate | 300 g |
| Water was added to | 600 ml |

After completing the addition, desalination was carried out using a 5% aqueous solution of DEMOL N made by Kao Atlas and a 20% aqueous solution of sulfuric acid. Then, an aqueous gelatin solution was mixed therewith, so that a monodispersed cubical grain emulsion EMP-1 having an average grain size ($\bar{r}$) of 0.85 μm, a coefficient of variation ($\sigma/\bar{r}$) of 0.07, wherein $\sigma$ is a standard deviation of grain size and silver chloride content of 99.5 mol% was obtained.

Subsequently, the emulsion EMP-1 was chemically ripened at 50° C. for 90 minutes using the following compounds, in order to obtain a blue-sensitive silver halide emulsion (Em A).

| | |
|---|---|
| Sodium thiosulfate | 0.8 mg/mol AgX |
| Chloroauric acid | 0.5 mg/mol AgX |
| Stabilizer (SB-5) | $6 \times 10^{-4}$ mol/mol AgX |
| Sensitizing dye (the above BS-4) | $5 \times 10^{-4}$ mol/mol AgX |

[Preparation of a green-sensitive silver halide emulsion]

There was prepared a monodispersed cubical grain emulsion EMP-2 having an average grain size of 0.43 μm, coefficient of variation ($\sigma/\bar{r}$) of 0.08 and silver chloride content of 99.5 mol% in the same manner as in EMP-1, except that the addition time of Solution A and Solution B and that of Solution C and Solution D were altered.

Then, the emulsion EMP-2 was chemically ripened at 55° C. for 120 minutes using the following compounds; thus, a green-sensitive silver halide emulsion (Em B) was obtained.

| | |
|---|---|
| Sodium thiosulfite | 1.5 mg/mol AgX |
| Chloroauric acid | 1.0 mg/mol AgX |
| Stabilizer (SB-5) | $6 \times 10^{-4}$ mol/mol AgX |
| Sensitizing dye (the above GS-1) | $4 \times 10^{-4}$ mol/mol AgX |

[Preparation of a red-sensitive silver halide emulsion]

A monodispersed cubical grain emulsion EMP-3 having an average grain size of 0.50 μm, coefficient of variation ($\sigma/\bar{r}$) of 0.08 and silver chloride content of 99.5 mol% was prepared in the same manner as in EMP-1, except that the addition time of Solution A and Solution B and that of Solution C and Solution D were altered.

Then, the emulsion EMP-3 was chemically ripened at 60° C. for 90 minutes using the following compounds; thus, a red-sensitive silver halide emulsion (Em C) was obtained.

| | |
|---|---|
| Sodium thiosulfite | 1.8 mg/mol AgX |
| Chloroauric acid | 2.0 mg/mol AgX |
| Stabilizer (SB-5) | $6 \times 10^{-4}$ mol/mol AgX |

Sensitizing dye (the above RS-7) $1.0 \times 10^{-4}$ mol/mol AgX SB-5

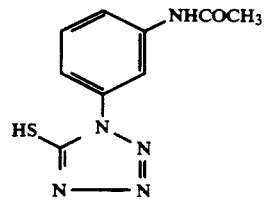

Through the procedure described above, a silver halide color photographic light-sensitive material, Sample 101, was prepared.

Next, Sample 102 was prepared by adding 0.5 g/m$^2$ of FLW-1 in the 2nd layer, Sample 103 by adding 0.19 g/m$^2$ of FLO-1 in the 2nd layer, and Sample 104 by adding 0.44 g/m$^2$ of Exemplified Compound 2 in the 1st layer. Further, Samples 105 and 106 were prepared by adding molar equivalents of FLO-2 and FLO-3, respectively.

In preparing these samples, FLW-1 was added as an aqueous solution, FLO-1 was added in the form of dispersion prepared by dissolving it in DIDP together with an antistain agent and then emulsifying the solution by a conventional method, and Exemplified Compound 2 was also added in the form of dispersion prepared by being dissolved in DNP together with a yellow coupler, dye image stabilizer and antistain agent and then being emulsified by a conventional method (in this case, the amount of the yellow coupler was reduced by a molar equivalent of Exemplified Compound 2).

| Processing | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

Color developer

| | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediamine tetraacetate | 1.0 g |
| Disodium catechol-3,5-diphosphonate | 1.0 g |

-continued

| | |
|---|---|
| N-ethyl-N-β-methanesulfonamidoethyl-3-methyl-4-aminoaniline sulfate | 4.5 g |
| Fluorescent brightener (4,4'-diaminostilbene disulfonic acid derivative) | 1.0 g |
| Potassium carbonate | 27 g |
| Water was added to 1 liter, then pH was adjusted to 10.10. | |
| Bleach-fixer | |
| Ammonium ferric ethylenediamine tetraacetate (dihydrate) | 60 g |
| Ethylenediamine tetraacetate | 3 g |
| Ammonium thiosulfate (70% aqueous solution) | 100 ml |
| Ammonium sulfite (40% aqueous solution) | 27.5 ml |
| Water was added to 1 liter, and then pH was adjusted to 5.7 with potassium carbonate or glacial acetic acid. | |
| Stabilizer | |
| 5-chloro-2-methyl-4-isothiazoline-3-on | 1.0 g |
| Ethylene glycol | 1.0 g |
| 1-hydroxyethylidene-1,1-diphosphonic acid | 2.0 g |
| Ethylenediamine tetraacetate | 1.0 g |
| Ammonium hydroxide (20% aqueous solution) | 3.0 g |
| Fluorescent brightener (4,4'-diaminostilbene disulfonic acid derivative) | 1.5 g |
| Water was added to 1 liter, and then pH was adjusted to 7.0 with sulfuric acid or potassium hydroxide. | |

FLW-1

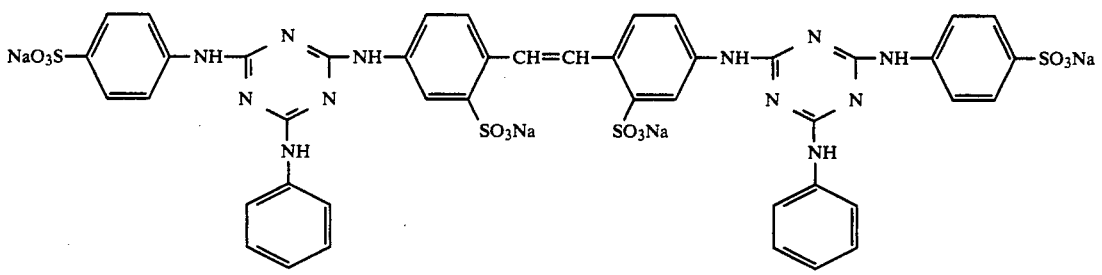

FLO-1

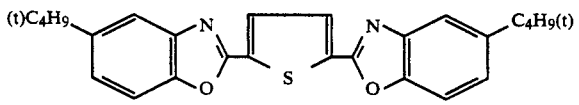

FLO-2

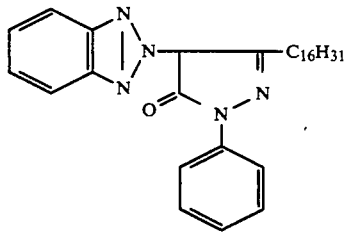

FLO-3

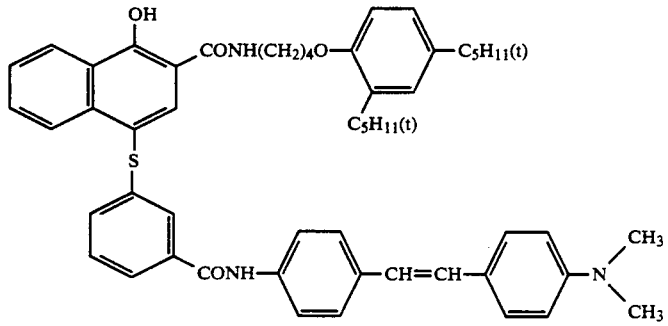

(Inspect static marks)

Each of the samples prepared as the above was divided into several portions. One portion of each sample was subjected to repeat conveyances of 50 cycles in an automatic printer, Konica Color Printer Model KCP-7N3, at a conveying speed of 9,000 sheets/hour in an environment of 25° C. and 20% RH. Separately, a strip of adhesive tape (ESLON No. 360 made by Sekisui Chemical) was stuck on the emulsion layer of another portion of each sample and then peeled off. Next, the sample was developed and then inspected for static marks.

(Evaluation of relative fluorescent intensity)

Reflective densities of the samples developed without being exposed were measured, with a color analyzer model 607 (made by Hitachi) having a xenon lamp as a light source.

Subsequently, a colored glass filter L-39 (made by Toshiba Glass) was placed in front of the lamp, then the reflective densities were measured. The value of a difference in reflective densities at the maximum fluorescent wavelength between one measured without the filter and one measured with the filter, relative to that of Sample 102 which was taken as 100 was defined as a relative fluorescent intensity.

(Evaluation of scratch strength)

Samples were immersed in the foregoing developer for 45 seconds and then evaluated for the scratch strength (g) with a scratch meter (made by Heydon).

The evaluation results are shown in Table 2.

TABLE 2

| Sample No. | Fluorescent compound | Static mark: Conveyed in printer | Static mark: Tape peeled off | Relative fluorescent intensity | Scratch strength (g) |
|---|---|---|---|---|---|
| 101 | — | not occurred | not occurred | 0 | 60 |
| 102 | FLW-1 | Largely occurred | Largely occurred | 100 | 48 |
| 103 | FLO-1 | Largely occurred | Largely occurred | 105 | 45 |
| 104 | Exemplified compound (2) | not occurred | not occurred | 131 | 60 |
| 105 | FLO-2 | Occurred | Largely occurred | 54 | 59 |
| 106 | FLO-3 | Largely occurred | Largely occurred | 108 | 57 |

As shown in Table 2, generation of static marks was noticeable when a water-soluble fluorescent brightener, oil-soluble fluorescent brightener and comparative fluorescent coupler were used. Deterioration in film properties was also observed when these water-soluble and oil-soluble fluorescent brightener were used. Further, when these samples were uniformly exposed and developed so as to give a density of approximately 1.0 and then visually checked, uneven coatings were observed in Samples 102 and 103, but no coating defects were observed in the other samples.

EXAMPLE 2

Samples 201 to 208 were prepared in the same manner as in preparation of Sample 101 of Example 1, except that the fluorescent compounds were added as shown in Table 3. Then, the samples were measured for relative fluorescent intensities; further, these samples were exposed to obtain the maximum density (to make them black samples) and visually inspected.

The evaluation results are shown in Table 3.

When a fluorescent compound was used as a coupler in the preparation of the above samples, the amount of coupler used was reduced by the molar equivalent. In case of a cyan coupler, it was replaced in preference to CC-3.

TABLE 3

| Sample No. | Fluorescent compound | Adding position | Addition amount | Relative fluorescent intensity | Rating of blackness |
|---|---|---|---|---|---|
| 101 | — | — | — | 0 | Good |
| 102 | FLW-1 | 2nd layer | 0.50 g/m$^2$ | 100 | Bluish, density seems to be decreased |
| 103 | Exemplified compound (2) | 1st layer | 0.44 g/m$^2$ | 131 | Good |
| 201 | Exemplified compound (12) | 3rd layer | 0.40 g/m$^2$ | 152 | Good |
| 202 | Exemplified compound (11) | 5th layer | 0.40 g/m$^2$ | 170 | Slightly bluish |
| 203 | Exemplified compound (10) | 2nd layer | 0.27 g/m$^2$ | 138 | Good |
| 204 | Exemplified compound (2) | 1st layer | 0.22 g/m$^2$ | 146 | Good |
| | Exemplified compound (12) | 3rd layer | 0.21 g/m$^2$ | | |
| 205 | Exemplified compound (10) | 2nd layer | 0.18 g/m$^2$ | 165 | Good |
| | Exemplified compound (11) | 5th layer | 0.13 g/m$^2$ | | |
| 207 | Exemplified compound (2) | 1st layer | 0.15 g/m$^2$ | 163 | Good |
| | Exemplified compound (12) | 3rd layer | 0.14 g/m$^2$ | | |
| | Exemplified compound (11) | 5th layer | 0.13 g/m$^2$ | | |
| 208 | Exemplified compound (10) | 4th layer | 0.27 g/m$^2$ | 151 | Good |

As apparent from Table 3, in case the compound of the invention was distributed among various photographic structural layers according to its spectral absorption characteristics, defects such as bluing of black samples can be substantially reduced, though a high relative fluorescent intensity is attained. Particularly, the addition in the 1st to 4th layers gave preferred results.

When generation of static marks was inspected as in Example 1, obvious static marks were observed in Sample 102, but not in the other samples.

When samples were prepared and evaluated in this example by replacing Exemplified compound (2) with a molar equivalent of Exemplified compound (8) and Exemplified compound (10) with that of Exemplified compound (9), the results obviously demonstrated the effect of the invention.

EXAMPLE 3

Silver halide emulsions were prepared by altering sensitizing dyes as shown in Table 4 by the procedure of making silver halide emulsion described in Example 1. Samples of light-sensitive material were prepared using these emulsions in combination. After running the developing equipment with Samples 102 and 104 independently till the replenished volume of a color developer reached three times the capacity of the tank. Then, the above samples were developed without being exposed (the sample containing a fluorescent compound FLW-1 was developed in the processing solution used for Sample 102, and the sample containing Exemplified compound (2) in the processing solution used for Sample 104) and evaluated for the residual dye stain.

The results are shown in Table 4.

The residual dye stain was rated by taking Sample 301 as a standard and shown by the density difference at λmax of each dye.

TABLE 4

| Sample No. | Sensitizing dyes 1st layer | 3rd layer | 5th layer | Fluorescent compound | Residual dye stain |
|---|---|---|---|---|---|
| 301 | — | — | — | Exemplified compound (2) | — |
| 302 | BS-4 | — | — | Exemplified compound (2) | 0.003 |
| 303 | BS-4 | — | — | Exemplified compound (2) | 0.004 |
| | BS-1 | — | — | | |
| 304 | BS-4 | — | — | Exemplified compound (2) | 0.003 |
| | BS-7 | — | — | | |
| 305 | BS-4 | — | — | Exemplified compound (2) | 0.003 |
| | BS-8 | — | — | | |
| 306 | BS-6 | — | — | Exemplified compound (2) | 0.006 |
| 307 | BS-7 | — | — | Exemplified compound (2) | 0.009 |
| 308 | BS-7 | — | — | FLW-1 | 0.011 |
| 309 | — | GS-1 | — | Exemplified compound (2) | 0.017 |
| 310 | — | GS-2 | — | Exemplified compound (2) | 0.019 |
| 311 | — | GS-4 | — | Exemplified compound (2) | 0.018 |
| 312 | — | GS-4 | — | FLW-1 | 0.020 |
| 313 | — | — | RS-3 | Exemplified compound (2) | 0.010 |
| 314 | — | — | RS-5 | Exemplified compound (2) | 0.015 |
| 315 | — | — | RS-7 | Exemplified compound (2) | 0.013 |
| 316 | — | — | RS-7 | FLW-1 | 0.016 |

It will be understood from Table 4 that the silver halide photographic light-sensitive materials of the invention are capable of providing excellent whiteness less in residual dye stain even if any sensitizing dye is used.

In case fluorescent compounds were incorporated in the silver halide emulsions of this example by varying as shown in Example 2, the evaluation results supported the effect of the invention, too. Any of these dyes is a sensitizing dye high in sensitivity and capable of providing a preferable spectral sensitivity distribution. Use of these sensitizing dyes is one of the preferred embodiments of the present invention.

As replenishing solutions for the running treatment of this example, the same bleach-fixer and stabilizer as those described above were used, while a developer was prepared as follows:

| Color developer replenishment | |
|---|---|
| Water | 800 ml |
| Triethanolamine | 10 g |
| N,N-diethylhydroxylamine | 7 g |
| Potassium bromide | 0.1 g |
| Potassium chloride | 3 g |
| Potassium sulfite | 0.8 g |
| 1-hydroxyethylidene-1,1-diphosphonic acid | 1.0 g |
| Ethylenediamine tetraacetate | 1.0 g |

-continued

| | |
|---|---|
| Disodium catechol-3,5-diphosphonic acid | 1.0 g |
| N-ethyl-N-(β-methanesulfonamidoethyl)-3-methyl-4-amonoaniline sulfate | 5.6 g |
| Fluorescent brightener (4,4'-diamonostilbene derivative) | 1.2 g |
| Potassium carbonate | 27 g |
| Pure water was added to 1 liter, then pH was adjusted to 10.40. | |

The running treatment of this example was carried out by filling an automatic processing machine with the foregoing color developer, bleach-fixer and stabilizer and then, while color paper samples were processed, supplying the above color developer replenisher, bleach-fixer replenisher and washing replenisher at intervals of 3 minutes through a volume measuring pump.

The replenishing volume to a color developer tank was 180 ml per m of color paper, that to a bleach-fixer tank was 220 ml of the bleach-fixer replenisher per $m^2$ of the paper, and that to a stabilizer tank was 250 ml of the stabilizer replenisher per $m^2$ of the paper.

The stabilizing unit of the automatic processing machine consisted of the 1st and 2nd tanks installed in the flow direction of a light-sensitive material, and replenishing was performed from the last tank by the two-tank counterflow method, in which the solution overflown from the last tank was poured into the preceding tank.

EXAMPLE 4

Color papers were prepared in the same manner as in Example 1 except that types and addition amounts of anti-irradiation dye were altered and all the amount was added to the 6th layer; running solutions were prepared using Samples 102 and 104 as in Example 3, and then the residual dye stains were checked.

The results are shown in Table 5.

The addition amount of anti-irradiation dyes was adjusted so as to make the absorption at λmax of a coated sample uniform in each of yellow, magenta and cyan dyes (AI-9 was used as a standard for yellow, AI-7 for magenta, and AI-1 for cyan).

TABLE 5

| Sample No. | Anti-irradiation dye | Fluorescent compound | Residual dye stain |
|---|---|---|---|
| 401 | — | Exemplification (2) | — |
| 402 | AI-1 0.02 g/$m^2$ | Exemplification (2) | 0.012 |
| 403 | AI-1 0.02 g/$m^2$ | FLW-1 | 0.014 |
| 404 | AI-7 0.01 g/$m^2$ | Exemplification (2) | 0.007 |
| 405 | AI-7 0.01 g/$m^2$ | FLW-1 | 0.008 |
| 406 | AI-9 0.01 g/$m^2$ | Exemplification (2) | 0.006 |
| 407 | AI-9 0.01 g/$m^2$ | FLW-1 | 0.008 |
| 408 | AI-3 | Exemplification (2) | 0.010 |
| 409 | AI-4 | Exemplification (2) | 0.009 |
| 410 | AI-A | Exemplification (2) | 0.016 |
| 411 | AI-A | FLW-1 | 0.019 |
| 412 | AI-6 | Exemplification (2) | 0.008 |
| 413 | AI-10 | Exemplification (2) | 0.007 |
| 414 | AI-8 | Exemplification (2) | 0.006 |
| 415 | AI-11 | Exemplification (2) | 0.005 |

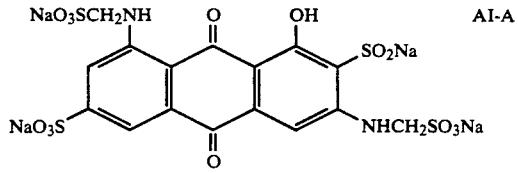

AI-A

As shown in Table 5, the silver halide photographic materials of the invention are capable of providing excellent whiteness which is less in residual dye stain even if any anti-irradiation dye is used. The anti-irradiation dyes of which usages are exemplified are less in residual dye stain and thereby particularly preferred.

When fluorescent compounds were changed as shown in Example 2 and combined with the anti-irradiation dyes used in this example, the evaluation results proved the positive effect of the invention.

EXAMPLE 5

Samples were prepared and evaluated for residual dye stain by the same procedure as that described in Examples 3 and 4, except that the surfactant SU-1 employed to emulsify couplers was replaced with surfactants e-1 and e-10.

The results are shown in Tables 6 and 7.

TABLE 6

| Sample No. | Sensitizing dyes 1st layer | 3rd layer | 5th layer | Surfactant | Fluorescent compound | Residual dye stain |
|---|---|---|---|---|---|---|
| 301 | — | — | — | SU-1 | Exemplification (2) | — |
| 501 | — | — | — | e-1 | Exemplification (2) | 0.000 |
| 302 | BS-2 | — | — | SU-1 | Exemplification (2) | 0.008 |
| 502 | BS-2 | — | — | e-1 | Exemplification (2) | 0.006 |
| 309 | — | GS-1 | — | SU-1 | Exemplification (2) | 0.017 |
| 503 | — | GS-1 | — | e-1 | Exemplification (2) | 0.015 |
| 341 | — | — | RS-7 | SU-1 | Exemplification (2) | 0.013 |
| 504 | — | — | RS-7 | e-1 | Exemplification (2) | 0.011 |
| 505 | — | — | RS-7 | e-1 | Exemplification (2) | 0.011 |

TABLE 7

| Sample No. | Anti-irradiation dye | Fluorescent compound | Residual dye stain | Surfactant |
|---|---|---|---|---|
| 401 | — | Exemplification (2) | — | SU-1 |
| 506 | — | Exemplification (2) | 0.000 | e-1 |
| 402 | AI-1 0.02 g/m$^2$ | Exemplification (2) | 0.012 | SU-1 |
| 507 | AI-1 0.02 g/m$^2$ | Exemplification (2) | 0.009 | e-1 |
| 404 | AI-7 0.02 g/m$^2$ | Exemplification (2) | 0.007 | SU-1 |
| 508 | AI-7 0.02 g/m$^2$ | Exemplification (2) | 0.006 | e-1 |
| 406 | AI-9 0.01 g/m$^2$ | Exemplification (2) | 0.006 | SU-1 |
| 509 | AI-9 0.02 g/m$^2$ | Exemplification (2) | 0.005 | e-1 |
| 510 | AI-1 0.02 g/m$^2$ | Exemplification (2) | 0.009 | e-1 |

It will be understood from Tables 6 and 7 that the use of a surfactant represented by Formula [e-I] enhances the effect of the invention and facilitates reduction of residual dye stain, for any of sensitizing dyes and anti-irradiation dyes.

Similar advantageous results were obtained when (e-5), (e-6) and (e-9) were evaluated likewise.

EXAMPLE 6

Samples were prepared by the same procedure as in Example 1, except that the following silver chlorobromide emulsions were used as color-sensitive emulsions in the preparation of Samples 101 to 106 in Example 1.

These color-sensitive emulsions were prepared as follows:

(Blue-sensitive silver chlorobromide emulsion)

A silver chlorobromide emulsion having an average grain size of 0.7 μm and a silver bromide content of 90 mol% was optimumly sensitized with sodium thiosulfate at 57° C., and a sensitizing dye (the above BS-4) and a stabilizer Z-1 were added thereto.

(Green-sensitive silver chlorobromide emulsion)

A silver chlorobromide emulsion having an average grain size of 0.5 μm and a silver bromide content of 70 mol% was optimumly sensitized with sodium thiosulfate at 57° C., and a sensitizing dye (the above GS-1) and a stabilizer Z-1 were added thereto.

(Red-sensitive silver chlorobromide emulsion)

A silver chlorobromide emulsion having an average grain size of 0.4 m and a silver bromide content of 60 mol% was optimumly sensitized at 60° C. with the addition of sodium thiosulfate, a sensitizing dye (the above RS-7) and a phenol resin, followed by addition of stabilizer Z-1.

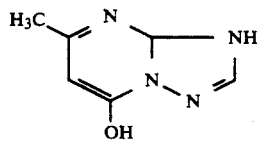

Z-1

Samples prepared as the above were exposed by a conventional method and processed according to the following procedure:

Standard processes (processing temperature and processing time)

| | Temperature | Time |
|---|---|---|
| Color developing | 38° C. | 3 min 30 sec |
| Bleach-fixing | 33° C. | 1 min 30 sec |
| Washing | 25 to 30° C. | 3 min |
| Drying | 75 to 80° C. | ca. 2 min. |

Compositions of processing solutions

| | |
|---|---|
| [Color developer] | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphonic acid (TPPS) | 2.5 g |
| N-ethyl-N-(β-methanesulnamidoethyl)-3-methyl-4-aminoaniline sulfate | 5.5 g |
| Fluorescent brightener (4,4'-diaminostilbenedisulfonic acid derivative) | 1.0 g |
| Potassium hydroxide | 2.0 g |
| Water was added to 1 liter, and pH was adjusted to 10.20 with potassium hydroxide or sulfuric acid. | |
| [Bleach-fixer] | |
| Ammonium ferric ethylenediamine tetraacetate (dihydrate) | 60 g |
| Ethylenediamine tetraacetate | 3 g |
| Ammonium thiosulfate (70% solution) | 100 ml |

-continued

| | |
|---|---|
| Ammonium thiosulfite (40% solution) | 27.5 ml |
| pH was adjusted to 7.1 with ammonium carbonate or glacial acetic acid, and water was added to 1 liter. | |

When the above samples were evaluated in the same manner as in Example 1, the effect of the invention was confirmed by their excellent film strength and fluorescent intensity as well as their less liability to generate static marks in an printer, in spite of their lower silver chloride content and a longer processing time they undergone.

EXAMPLE 7

Samples 701 and 702 were prepared by the same procedure as in Example 1, except that the support used in Samples 101 and 104 of Example 1 was changed to a polyester (polyethylene terephthalate) film containing 20 g of barium sulfate per 100 g of the resin; Samples 703 and 704 were prepared by changing the support to a polypropylene film containing 20 g of barium sulfate in 100 g of the resin, and Samples 705 and 706 were made by changing the support to a composite support prepared by laminating an aluminum-deposited polyester film on the polyethylene-coated paper support used in Example 1. Further, Samples 707 and 708 were prepared by steps of forming, on a support obtained by coating 10 g/m$^2$ of titanium dioxide on the polyester film used in Samples 701 and 702, the same layers as in Example 1 except that some of the coating amounts were changed to the following values:

| | | |
|---|---|---|
| 6th layer | anti-irradiation dye | 0.09 g/m$^2$ |
| 5th layer | all the components | double |
| | but, gelatin | 1.90 g/m$^2$ |
| 3rd layer | all the components | double |
| | but, gelatin | 2.0 g/m$^2$ |
| | anti-irradiation dye | 0.04 g/m$^2$ |
| 1st layer | all the components | double |

and coating the following layers on the reverse side of the support:

| | | |
|---|---|---|
| 1st BC layer | gelatin | 2.0 g/m$^2$ |
| | UV absorbent (UV-1) | 0.2 g/m$^2$ |
| | UV absorbent (UV-2) | 0.1 g/m$^2$ |
| | colloidal silver | 0.1 g/m$^2$ |
| 2nd BC layer (Protective layer) | gelatin | 1.0 g/m$^2$ |
| | colloidal silver | 0.05 g/m$^2$ |

The evaluation of these samples in the same manner as in Example 1 (but, Samples 707 and 708 were processed by color developing: 90 sec, bleach-fixing: 90 sec, stabilizing: 180 sec, drying: 120 sec) demonstrated the effect of the invention.

These samples were exposed through a color negative and developed to obtain color prints. When the prints were illuminated with spotlight of a tungsten halogen lamp, Samples 702, 704 and 706 according to the invention reproduced high bright subjects sharply and brilliantly. While Sample 705 exhibited the same effect when viewed in a specific direction, it gave a dark reproduction when the visual angle was changed.

When Samples 707 and 708 were illuminated from the reverse side with a white fluorescent lamp (FL20S SW made by Toshiba), it was observed that highly bright subjects were reproduced more sharply and more brilliantly. This indicates that the effect of the invention can be fully demonstrated in a light-sensitive material for display which is illuminated from the reverse side.

EXAMPLE 8

Direct positive samples were prepared by the following method, using the same couplers, high boiling solvents and dye image stabilizers as in Example 1.

[Preparation of Emulsion EM-1]

While vigorously stirring an aqueous solution of ossein gelatin at 55° C., an aqueous solution of silver nitrate and an aqueous solution containing potassium bromide and sodium chloride (KBr:NaCl=40:60 in molar ratio) were simultaneously added thereto by the controlled double-jet method, and thereby a cubical silver chlorobromide grain emulsion A having an average grain size of 0.3 μm was obtained. Using the emulsion A as core grains, the aqueous solution of silver nitrate and an aqueous solution of sodium chloride were simultaneously added by the double-jet method at 55° C. and pAg of 6. There was obtained a cubical monodispersed core/shell type grain emulsion (EM-1) having an average grain size of 0.6 μm and an extent of distribution* of 8%.

Extension of distribution (%) =

$$\frac{\text{Standard deviation of grain size}}{\text{Average grain size}} \times 100$$

[Compositions of light-sensitive layers]

In the following compositions, the addition amount is given by g/m$^2$, and the amount of silver halide is shown in a silver equivalent.

| | |
|---|---|
| 1st layer (red-sensitive layer) | |
| Red-sensitive emulsion prepared by spectrally sensitized EM-1 with red-sensitive sensitizing dyes (the above RS-5 and RS-6) | 0.4 |
| Gelatin | 1.38 |
| Cyan coupler (the above CC-3) | 0.21 |
| Cyan coupler (the above CC-8) | 0.21 |
| Dye image stabilizer (the above a-7) | 0.22 |
| Solvent (DOP) | 0.33 |
| 2nd layer (intermediate layer) | |
| Gelatin | 0.75 |
| Antistain agent (HQ-1) | 0.06 |
| Solvent (DOP) | 0.07 |
| 3rd layer (green-sensitive layer) | |
| Green-sensitive emulsion prepared by spectrally sensitized EM-1 with a green-sensitive sensitizing dye (the above GS-1) | 0.27 |
| Gelatin | 1.3 |
| Magenta coupler (the above M-63) | 0.24 |
| Dye image stabilizer (the above IV-21) | 0.20 |
| Solvent (DNP) | 0.32 |
| 4th layer (intermediate layer) | |
| The same as the 2nd layer. | |
| 5th layer (yellow filter layer) | |
| Gelatin | 0.42 |
| Yellow colloidal silver | 0.10 |
| UV absorbent (the above UV-1) | 0.05 |
| UV absorbent (the above UV-2) | 0.14 |
| Antistain agent (the above HQ-1) | 0.04 |
| Solvent (DNP) | 0.08 |
| 6th layer (antistain layer) | |
| Gelatin | 0.40 |
| Antistain agent (the above HQ-1) | 0.03 |
| Solvent (DOP) | 0.04 |
| 7th layer (blue-sensitive layer) | |
| Blue-sensitive emulsion prepared by spectrally | 0.50 |

-continued

| | |
|---|---|
| sensitized EM-1 with a blue-sensitive sensitizing dye (the above BS-4) | |
| Gelatin | 1.35 |
| Yellow coupler (Y-8) | 0.0012 mol/m$^2$ |
| Dye image stabilizer (ST-1) | 0.30 |
| High boiling water-insoluble organic solvent (DNP) | 0.20 |
| High boiling water-soluble organic solvent (N,N-dimethylformamide) | 0.09 |
| 8th layer (ultraviolet absorbing layer) | |
| Gelatin | 0.54 |
| UV absorbent (the above UV-1) | 0.10 |
| UV absorbent (the above UV-2) | 0.28 |
| Solvent (DNP) | 0.12 |
| 9th layer (protective layer) | |
| Gelatin | 0.12 |

DOP: dioctyl phthalate
TOP: trioctyl phosphate

The sample prepared as the above was taken as Sample 801, and Sample 802 was prepared by adding 2.7 mg/gm$^2$ of Exemplified compound (10) to the 2nd layer of Sample 801 and changing the amount of solvent SO-2 in the layer to 4.2 mg/gm$^2$. These samples were evaluated on the same items as in Example 1, the results proved the effectiveness of the invention.

What is claimed is:

1. A silver halide photographic light-sensitive material comprising a support having thereon photographic component layers including a silver halide emulsion layer, wherein at least one of said photographic component layers contains a compound represented by Formula (I):

$$A—(Time)_n—FL—BF \qquad \text{Formula (1)}$$

wherein A represents a group capable of releasing a group of —(Time)$_n$—FL—BL upon reaction with an oxidation product of a developing agent; Time represents a timing group; FL represents a group which comes to emit fluorescence when a —BL is split off; BL represents a group capable of being split off and bound to FL by an $$-O-\overset{\overset{O}{\|}}{C}-$$

linkage in the manner $$FL'-O-\overset{\overset{O}{\|}}{C}-BL'$$

wherein FL'—O represents the FL moiety and $$\overset{\overset{O}{\|}}{C}-BL'$$

represents the BL moiety; and n represents an integer of 0 or 1.

2. A photographic material of claim 1, wherein A is a coupler residue capable of releasing the —(Time)n—FL—BL group upon reaction with an oxidation product of a developing agent.

3. A photographic material of claim 2, wherein the coupler residue is represented by one of the following Formulas [Ia] to [Ih]:

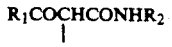
Formula [Ia]

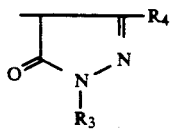
Formula [Ib]

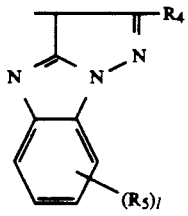
Formula [Ic]

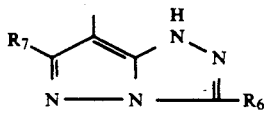
Formula [Id]

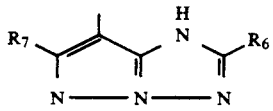
Formula [Ie]

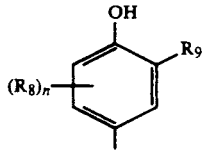
Formula [If]

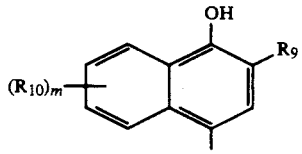
Formula [Ig]

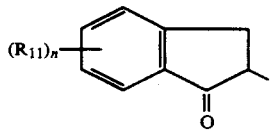
Formula [Ih]

wherein $R_1$ represents an alkyl, aryl or arylamino group; $R_2$ and $R_3$ independently represent an alkyl or aryl group; $R_4$ represents an alkyl, acylamino, arylamino, arylureido or alkylureido group; $R_5$ represents an acylamino, sulfonamido, alkyl, alkoxy group or a halogen atom; $R_6$ represents an alkyl or aryl group; $R_7$ represents an alkyl, aryl, acylamino, arylamino, alkoxy, arylureido .or alkylureido group; $R_8$ represents a halogen atom or an alkyl, alkoxy, acylamino or sulfonamido group; $R_9$ represents an acylamino, carbamoyl or arylureido group; $R_{10}$ represents an amino, substituted amino, amido, an sulfonamido or hydroxy group; $R_{11}$ represents a nitro, acylamino, succinimido, sulfonamido, alkoxy, alkyl or cyano group or a halogen atom; l represents an integer of from 0 to 3, n an integer of from 0 to 2, m an integer of 0 or 1; and when l or n is 2 or more, $R_5$, $R_8$ and $R_{11}$ may be the same or different from one another.

4. A photographic material of claim 1, wherein the compound represented by Formula [I] is contained in an amount of ranging from $1.0\times10^{-5}$ to $1.0\times10^{-2}$ mol/m$^2$ in terms of the coating amount.

5. A photographic material of claim 4, wherein the compound is contained in an amount of ranging from $1.0\times10^{-4}$ to $5.0\times10^{-3}$ mol/m$^2$.

6. A photographic material of claim 1, wherein said silver halide emulsion layer contains a sensitizing dye.

7. A photographic material of claim 1 or 6, wherein said silver halide emulsion layer contains a compound represented by the following formula [e-I]:

$$\begin{array}{l} R_{21}-CH-COAR_{23} \\ \quad\quad\;\; | \\ R_{22}-CH-COOR_{24} \end{array} \qquad \text{Formula [e-I]}$$

wherein one of $R_{21}$ and $R_{22}$ represents a hydrogen atom and the other is a group represented by the formula $-SO_3M$ in which M is a univalent positive ion: $R_{23}$ and $R_{24}$ independently represent an alkyl group having 4 to 16 carbon atoms; A represents an oxygen atom or a group represented by the formula $-NR_{25}-$ in which $R_{25}$ is a hydrogen atom or alkyl group having 1 to 8 carbon atoms.

* * * * *